US008477564B2

(12) United States Patent
Suzuki

(10) Patent No.: US 8,477,564 B2
(45) Date of Patent: Jul. 2, 2013

(54) TIMEPIECE WITH CALENDAR MECHANISM INCLUDING FIRST DATE INDICATOR AND SECOND DATE INDICATOR

(75) Inventor: Shigeo Suzuki, Chiba (JP)

(73) Assignee: Seiko Instruments Inc.

( * ) Notice: Subject to any disclaimer, the term of this patent is extended or adjusted under 35 U.S.C. 154(b) by 167 days.

(21) Appl. No.: 12/928,575

(22) Filed: Dec. 14, 2010

(65) Prior Publication Data

US 2011/0158052 A1 Jun. 30, 2011

(30) Foreign Application Priority Data

Dec. 24, 2009 (JP) ..... 2009-293161

(51) Int. Cl.
*G04B 19/247* (2006.01)

(52) U.S. Cl.
USPC ..... 368/37

(58) Field of Classification Search
USPC ..... 368/35–38
See application file for complete search history.

(56) References Cited

U.S. PATENT DOCUMENTS

| | | | | |
|---|---|---|---|---|
| 4,257,113 | A * | 3/1981 | Meister et al. | 368/35 |
| 6,081,483 | A | 6/2000 | Capt et al. | 368/28 |
| 6,735,151 | B2 * | 5/2004 | Triponez | 368/28 |
| 2005/0169108 | A1 | 8/2005 | Watanabe | 368/37 |
| 2005/0169109 | A1 * | 8/2005 | Watanabe | 368/37 |
| 2005/0174891 | A1 | 8/2005 | Besse | 368/37 |
| 2005/0232085 | A1 * | 10/2005 | Scheufele | 368/37 |
| 2006/0028918 | A1 * | 2/2006 | Groothuis et al. | 368/37 |
| 2007/0201312 | A1 * | 8/2007 | Watanabe | 368/37 |
| 2008/0279049 | A1 | 11/2008 | Schmiedchen et al. | 368/37 |
| 2009/0257318 | A1 | 10/2009 | Hiraya | 368/37 |

FOREIGN PATENT DOCUMENTS

| | | |
|---|---|---|
| WO | 99 13383 | 3/1999 |
| WO | WO 03071361 A2 * | 8/2003 |

OTHER PUBLICATIONS

Machine translation of WO03/071361A2, Finet, Jacques, translated Oct. 11, 2012.*

* cited by examiner

*Primary Examiner* — Vit W Miska
*Assistant Examiner* — Matthew Powell
(74) *Attorney, Agent, or Firm* — Adams & Wilks

(57) ABSTRACT

A timepiece with a calendar mechanism has a first date indicator provided with numbers for indicating the ones place of a date, and a second date indicator provided with numbers for solely indicating the tens place of the date and numbers for singly indicating the one-digit date. The first date indicator has 12 calendar feeding teeth formed as inner teeth. The calendar feeding teeth comprise first to tenth calendar feeding teeth spaced apart angularly in a first direction, an eleventh calendar feeding tooth arranged at an angular interval in a second direction opposite to the first direction relative to the first calendar feeding tooth, and a twelfth calendar feeding tooth arranged at an angular interval in the first direction relative to the eleventh calendar feeding tooth. The second date indicator has at least one window portion for displaying the ones place using the numbers of the first date indicator.

14 Claims, 22 Drawing Sheets

TIMEPIECE WITH CALENDAR MECHANISM INCLUDING FIRST DATE INDICATOR AND SECOND DATE INDICATOR

BACKGROUND OF THE INVENTION

1. Field of the Invention

The present invention relates to a timepiece with a calendar mechanism indicating $1^{st}$ to $31^{st}$ days by a first date indicator and a second date indicator. In particular, the present invention relates to a timepiece with a calendar mechanism capable of indicating dates in date letters larger than those of a conventional timepiece with a calendar mechanism.

2. Description of the Related Art

A mechanical structure including a drive portion of a timepiece is generally referred to as a "movement". What is completed by attaching a dial and hands to the movement and putting the whole in a timepiece case is referred to as the "complete" of the timepiece. Of both sides of a main plate constituting the base plate of the timepiece, the side where the glass of the timepiece case exists, that is, the side where the dial exists, is referred to as the "back side" or "glass side" or "dial side" of the movement. Of both sides of the main plate, the side where the case back of the timepiece case exists, that is, the side opposite to the dial side, is referred to as the "front side" or the "case back side" of the movement. A train wheel incorporated into the "front side" of the movement is referred to as the "front train wheel". A train wheel incorporated into the "back side" of the movement is referred to as the "back train wheel".

In the following, the construction of a conventional timepiece with a calendar mechanism including a first date indicator indicating the one place of a date, and a second date indicator indicating the ten place of a date, will be described.

(1) First Type Conventional Calendar Mechanism

A first type conventional calendar mechanism is equipped with a first date indicator indicating the one place of a date, a first date jumper for setting the position in the rotating direction of the first date indicator, a second date indicator indicating the ten place of a date, a second date jumper for setting the position in the rotating direction of the second date indicator, and a date intermediate wheel rotating based on the rotation of the first data indicator and capable of rotating the second date indicator. The first date indicator includes 31 first date indicator tooth portions formed as inner teeth, and four calendar feeding teeth formed as inner teeth. The calendar feeding teeth consist of a first calendar feeding tooth serving as a reference, a second calendar feeding tooth, a third calendar feeding tooth, and a fourth calendar feeding tooth; each calendar feeding tooth is equipped with a normal rotation feeding portion for feeding the first date indicator in a first direction, and a reverse rotation feeding portion for feeding the first date indicator in a second direction opposite to the first direction (See JP-A-2005-214836).

(2) Second Type Conventional Calendar Mechanism

A second type conventional calendar mechanism has a scale with four positions of "0" to "3" plus a blank, or "1" to "3" plus a blank, and includes a member advancing each 10 days to indicate the ten place, and a member advancing each 24 hours to indicate the one place. The member indicating the one place can assume 31 positions, and three scales on which the numbers "0" to "9" are successively arranged are successively mounted thereto. In one of the scales, an additional "1" is inserted between the numbers "0" and "1" (See Japanese Patent No. 4307613).

(3) Third Type Conventional Calendar Mechanism

A third type conventional calendar mechanism is equipped with a dial with a large window, and a one-place rotary member (i.e., the first date indicator) on which there are arranged 31 numbers including one number "1" and three sets of numbers "1" to "9" and "0" and which is equipped with four teeth; further, it is equipped with a ten-place star-shaped plate having four teeth, and a ten-place rotary member (i.e., the second date indicator) on which the numbers "0", "1", "2" and "3" are arranged. The one-place rotary member (i.e., the first date indicator) directly rotates the ten-place rotary member (i.e., the second date indicator) (See Japanese Patent No. 3390021).

(4) Fourth Type Conventional Calendar Mechanism

A fourth type conventional calendar mechanism is equipped with a rotary disc on which the successive numbers of "0" to "9" are arranged on a peripheral edge ring and which indicates the one place of a date, and a rotary disc on which the numbers "0", "1", "2", "3" and "3" arranged in that order are arranged on a peripheral edge ring and which indicates the ten place of a date. On the night of the $9^{th}$ day, on the night of the $19^{th}$ day, on the night of the $29^{th}$ day, on the night of the $30^{th}$ day and on the night of the $31^{st}$ day, the rotary disc indicating the ten place of a date moves from the position at that point in time to the next position. On the night of every day except for the $31^{st}$ day, the rotary disc indicating the one place of a date moves from a position to the next position (See Japanese Patent No. 4324550).

(5) Fifth Type Conventional Calendar Mechanism

A fifth type conventional calendar mechanism is equipped with a first indicating device indicating the one place of a date, and a second indicating device indicating the ten place of a date. The first indicating device and the second indicating device are driven by a program gear set, and a date wheel advances one step. During date change, the date wheel of the program gear set is driven by the peak of a lever. During the period of date change, the peak is engaged with the portion of the date wheel between first and second teeth. When date change occurs, the peak is disengaged from the first and second teeth of the date wheel, and gets between the second and third teeth of the date wheel, with the date wheel advancing one step (See JP-T-2009-531650).

(6) Sixth Type Conventional Calendar Mechanism

In a sixth type conventional calendar mechanism, a first moving member indicates the one place of a date, and complete dates of 1 through 9, and a second moving member indicates the ten place of a date, and complete $30^{th}$ and/or $31^{st}$ date. The moving member of a one-place ring is equipped with a driving protrusion. Due to this driving protrusion, it is possible to operate the moving member of a ten-place ring (See JP-T-2006-522323).

(7) Seventh Type Conventional Calendar Mechanism

A seventh type conventional calendar mechanism is equipped with a normal ten-place scale indicating a ten-place number solely through a ten-place date display hole, and a double display scale displaying a ten-place number through a ten-place date display hole and displaying a one-place number through a one-place date display hole. A one-place date plate is equipped with five ten-place drive teeth. A ten-place date indicator is rotated by the ten-place drive teeth (See JP-A-2009-250912).

In conventional timepieces with a calendar mechanism including a first date indicator and a second date indicator, the structure of the calendar mechanism is rather complicated and has a rather large thickness. Further, in conventional timepieces with a calendar mechanism including a first date indicator and a second date indicator, it is rather difficult to increase the size of the date letters of the first date indicator and of the date letter of the second date indicator. Further, in conventional timepieces with a calendar mechanism including a first date indicator and a second date indicator, to produce a timepiece with a calendar mechanism, there is involved a change on a rather large scale in the movement constituting the base.

SUMMARY OF THE INVENTION

It is an aspect of the present invention to provide a timepiece with a calendar mechanism including a first date indicator and second date indicator, wherein the first date indicator can indicate the one place of a date, and the second date indicator can indicate the ten place of a date, and can singly indicate a one-digit date, thereby providing a timepiece with a calendar mechanism which is equipped with a movement of a simple construction and which enable date display to be easily viewed.

According to the present invention, there is provided a timepiece with a calendar mechanism including two date indicators, comprising: a first date indicator capable of indicating the one place of a date; a first date jumper for setting the position in the rotating direction of the first date indicator; a second date indicator capable of indicating the ten place of a date and capable of singly indicating a one-digit date; and a second date jumper for setting the position in the rotating direction of the second date indicator. The first date indicator has a first date letter display surface. The first date letter display surface is provided with the numbers of "0", "1", "2", "3", "4", "5", "6", "7", "8" and "9" for indicating the one place of a date. The second date indicator has a second date letter display surface. The second date letter display surface is provided with numbers for singly displaying a one-digit date, and numbers for displaying solely the ten place of a date. Further, the second date indicator has a window portion for displaying the one place of a date by the numbers provided on the first date letter display surface. The second date letter display surface is arranged at a position closer to the dial than the first date letter display surface.

In the timepiece with a calendar mechanism of the present invention, the first date letter display surface is provided with the numbers of "0", "1", "2", "3", "4", "5", "6", "7", "8", "9", "0", "1", "2", "3", "4", "5", "6", "7", "8", "9", "0" and "1" for displaying the one place of a date, and the second date letter display surface is provided with the numbers of "1" through "9" for singly displaying a one-digit date and the numbers of "1", "2" and "3" for displaying the ten place of a date arranged at equal angular intervals; a window portion is formed between the number "1" for indicating the ten place and the number "2" for indicating the ten place; a window portion is formed between the number "2" for indicating the ten place and the number "3" for indicating the ten place; a window portion is formed between the number "1" for indicating the ten place and the number "9" for singly displaying a one-digit date; the number "1" for indicating the ten place, the number "2" for indicating the ten place, and the number "3" for indicating the ten place are formed at equal angular intervals; and the above-mentioned three window portions are preferably formed at equal angular intervals.

In the timepiece with a calendar mechanism of the present invention, the first date letter display surface is provided with the numbers of "0", "1", "2", "3", "4", "5", "6", "7", "8", "9", "0", "1", "2", "3", "4", "5", "6", "7", "8", "9", "0" and "1" at an angular interval of (360/31) degrees; the second date letter display surface is provided with the numbers of "1", "2", "3", "4", "5", "6", "7", "8" and "9" at an angular interval of (360/12) degrees, and a set of a first number and a window portion consisting of the number "1" and a first window portion, a set consisting of the number "2", a second number and a window portion, and a set of a third number and a window portion consisting of the number "3" and a third window portion, are provided at an angular interval of (360/12) degrees; the display of $1^{st}$ through $9^{th}$ days is effected solely with the numbers provided on the second date letter display surface; and, in displaying $10^{th}$ through $31^{st}$ days, the one place is indicated through the window portion of the second date indicator by using the numbers provided on the first date letter display surface, and the ten place is indicated by using the numbers provided on the second date letter display surface.

Due to this construction, it is possible to realize a timepiece with a calendar mechanism of a simple construction and of a large date display easy to view. In the timepiece with a calendar mechanism of the present invention, the second date indicator can singly indicate a one-digit date, that is, $1^{st}$ through $9^{th}$ days, so that it is advantageously possible to make a larger date display of $1^{st}$ through $10^{th}$ days than in the prior art.

In the timepiece with a calendar mechanism of the present invention, the first date indicator includes 31 first date indicator tooth portions formed as inner teeth, and 12 calendar feeding teeth formed as inner teeth; the first date indicator tooth portions are formed at an angular interval of (360/31) degrees; and the calendar feeding teeth preferably include 10 calendar feeding teeth formed at an angular interval of (360/31) degrees, that is, first through tenth calendar feeding teeth, an eleventh calendar feeding tooth formed at an angular interval of (360*10/31) degrees in a first direction opposite to the direction in which the first calendar feeding tooth is arranged, using the tenth calendar feeding tooth as a reference, and a twelfth calendar feeding tooth formed at an angular interval of (360*10/31) degrees in the first direction, using the eleventh calendar feeding tooth as a reference.

Due to this construction, it is possible to reduce the scale on which the movement constituting the base for the production of a timepiece with a calendar mechanism is changed, and it is possible to facilitate the production and assembly of the components of the movement.

In the timepiece with a calendar mechanism of the present invention, the rotation center of the first date indicator and the rotation center of the second date indicator are arranged at the same position, and there is preferably provided an intermediate date wheel capable of rotation based on the rotation of the first date indicator to rotate second date indicator. Due to this construction, it is possible to realize a timepiece with a calendar mechanism of a small size and of a large date display. Further, due to this construction, it is possible to reduce the scale on which the movement constituting the base is changed for the production of a timepiece with a calendar mechanism.

Further, in the timepiece with a calendar mechanism of the present invention, there may be provided on the second date letter display surface a number for singly displaying a two-digit date. Due to this construction, it is possible to enlarge the display of many dates.

According to the present invention, it is possible to realize a calendar indication of a large date display that is easy to see. In particular, in the timepiece with a calendar mechanism of the present invention, the display of the one-digit dates, that is, the display of $1^{st}$ through $9^{th}$ days is large and easy to see.

Further, according to the present invention, it is possible to reduce the scale on which the movement constituting the base is changed for the production of a timepiece with a calendar mechanism, making it possible to use the components of many movements in common.

Further, in the timepiece with a calendar mechanism of the present invention, the structure of the components of the movement is simple, and the components can be produced and assembled easily.

DETAILED DESCRIPTION OF THE PREFERRED EMBODIMENTS

Figure 1:
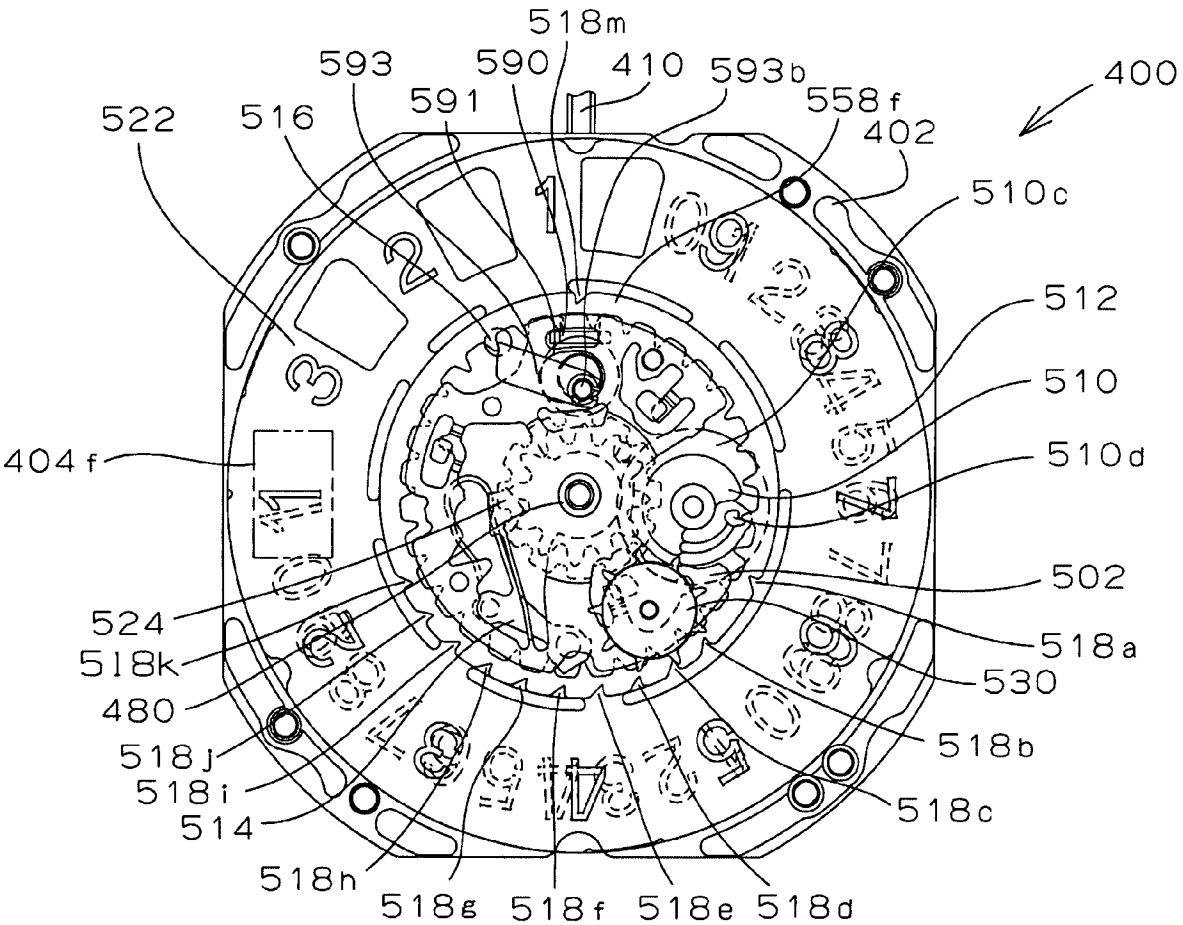
FIG. 1 is a schematic plan view, as seen from the dial side, of the structure of a movement in a timepiece with a calendar mechanism according to an embodiment of the present invention.

In the following, a timepiece with a calendar mechanism according to an embodiment of the present invention will be described with reference to the drawings.

(1) Structure of the Timepiece with a Calendar Mechanism of the Present Invention (1.1) General Construction of the Movement Referring to FIGS. 1 through 3 and 22, a movement 400 of a timepiece with a calendar mechanism according to an embodiment of the present invention is formed by an analog electronic timepiece. The movement 400 includes a base plate 402 constituting the base plate of the movement 400, and a date indicator maintaining plate 502. A dial 404 is attached to the movement 400. The dial 404 is attached to the glass side of the movement 400. In the movement 400, the "front side" refers to the side of both sides of the main plate 402 farther from the dial 404, that is, the "case back side". In the movement 400, the "back side" refers to the side of both sides of the main plate 402 nearer to the dial 404, that is, the "dial side". In the movement 400, the date indicator maintaining plate 502 is arranged on the "back side". A winding stem 410 is rotatably incorporated into the main plate 402. A clutch 472 is arranged so as to have the same rotation axis as the rotation axis of the winding stem 410. A switching-device/setting-device includes the winding stem 410, a train wheel setting lever 468, and a winding stem positioning portion 662*f* of a battery positive terminal 662. In the movement 400, the switching device is arranged on the "front side". In the movement 400, it is also possible for the switching device to be arranged on the "back side".

(1.2) Construction of the Front Side of the Movement

Figure 2:
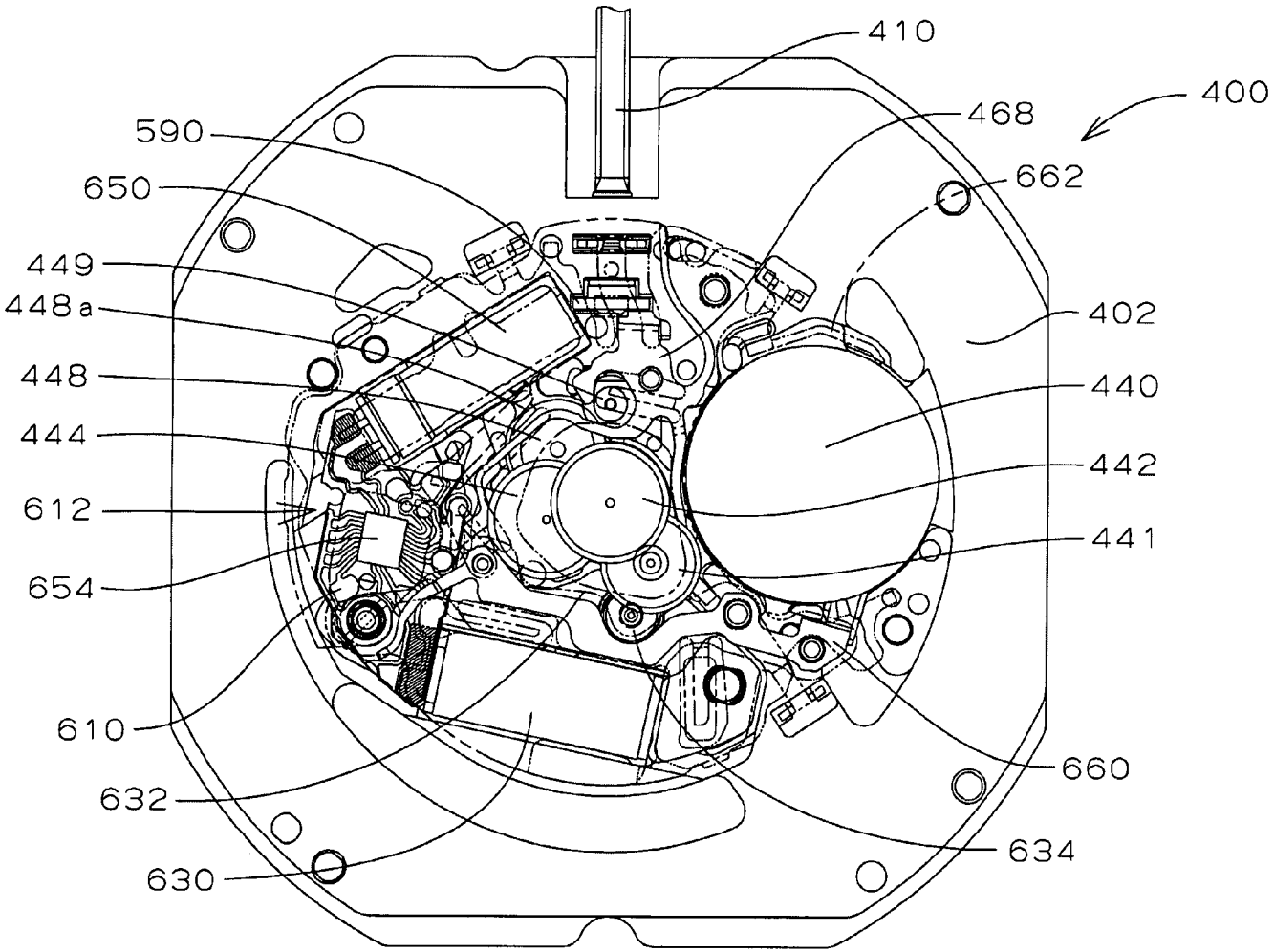
FIG. 2 is a schematic plan view, as seen from the case back side, of the structure of a movement in a timepiece with a calendar mechanism according to an embodiment of the present invention.
Figure 3:
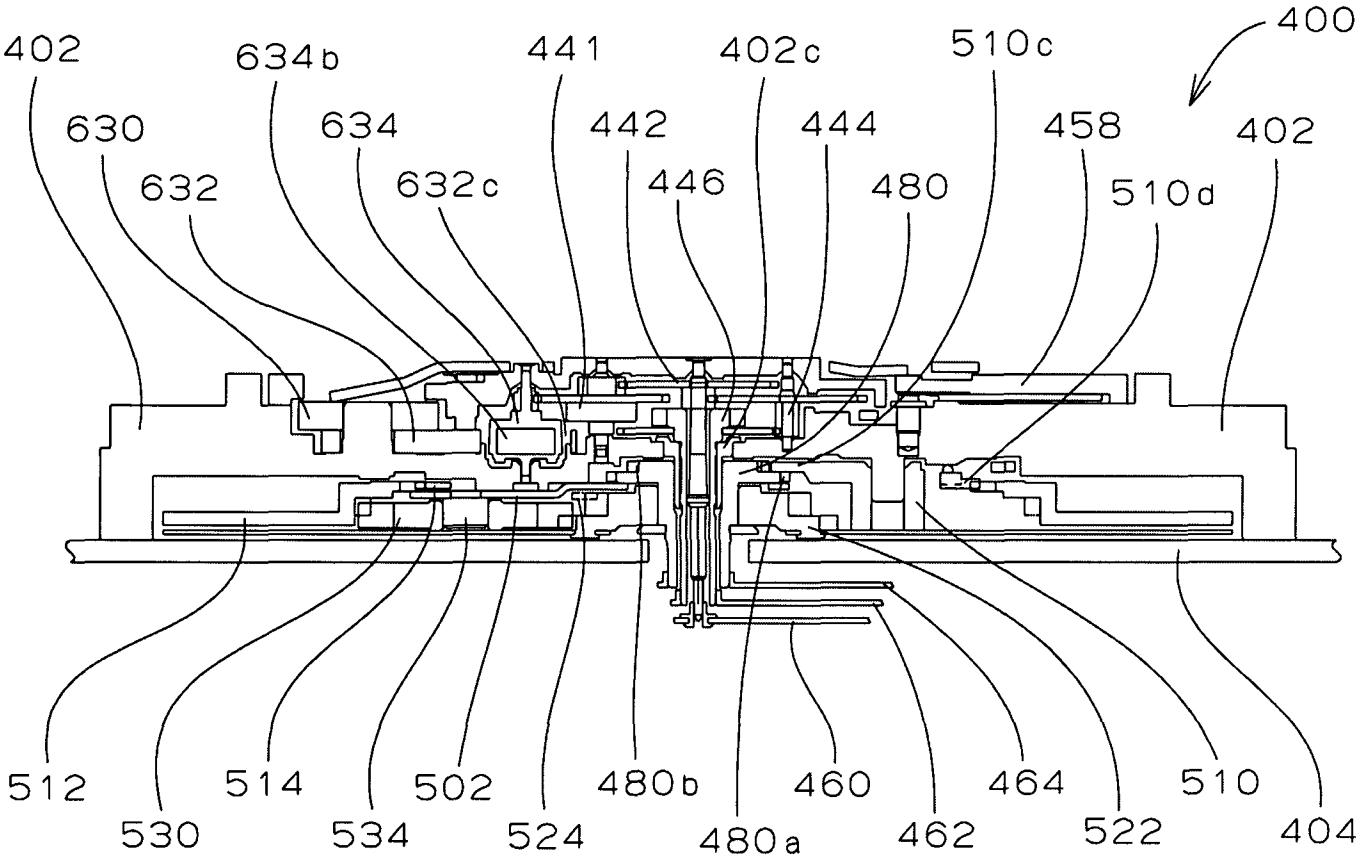
FIG. 3 is a partial sectional view of a front train wheel and a part of a calendar mechanism in a timepiece with a calendar mechanism according to an embodiment of the present invention.
Figure 21:
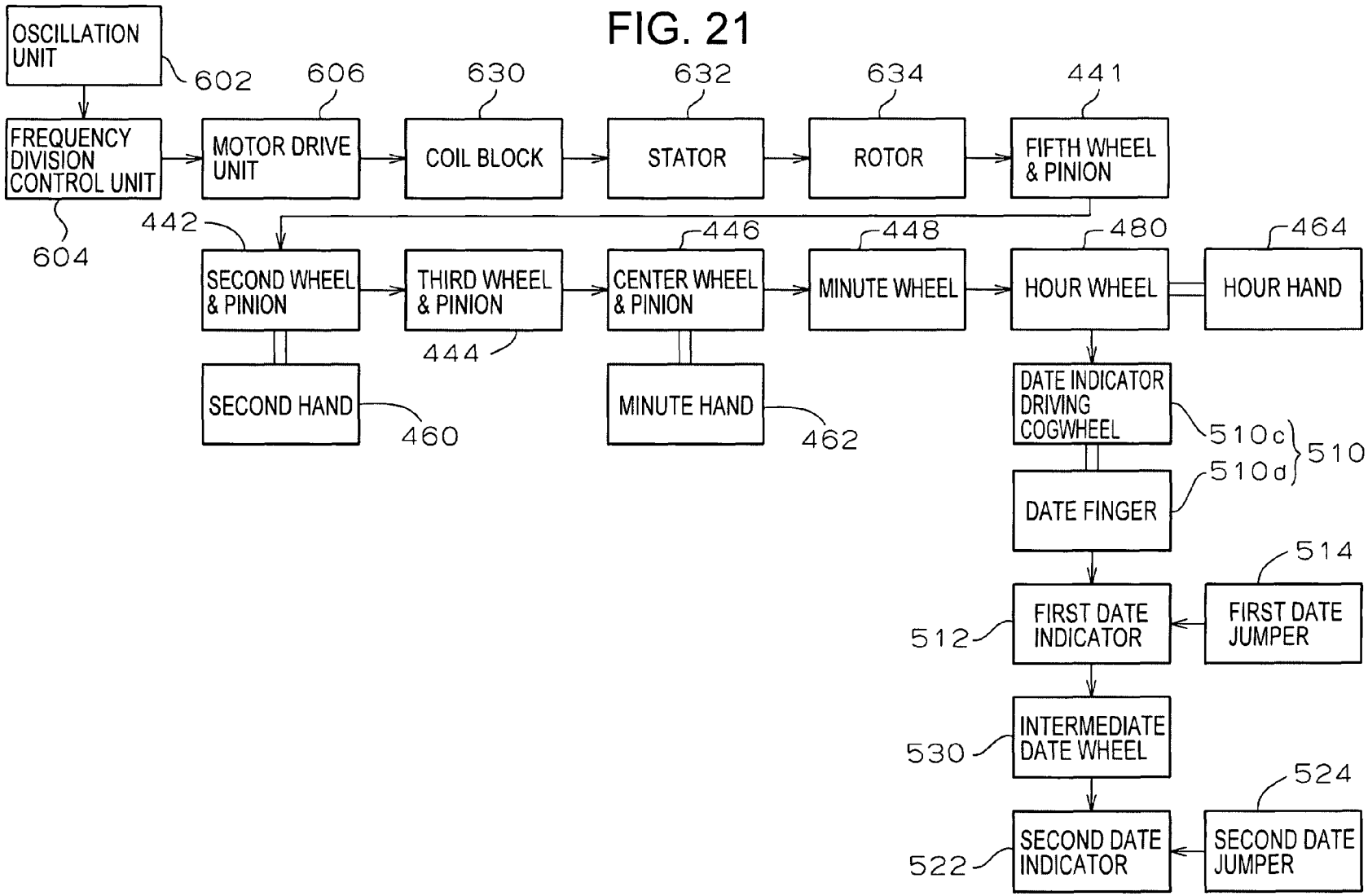
FIG. 21 is a block diagram showing a timepiece with a calendar mechanism according to an embodiment of the present invention, showing a drive circuit, a front train wheel, a calendar mechanism, etc.

In the following, the construction of the front side of the movement will be described. Referring to FIGS. 2, 3 and 21, in the movement 400, a battery 440 constituting the power source of the timepiece is arranged on the case back side (front side) of the main plate 402. A crystal oscillator unit 650 constituting the oscillation source of the timepiece is arranged on the case back side of the main plate 402. For example, a crystal oscillator oscillating at 32,768 Hz is accommodated in the crystal oscillator unit 650. An oscillation unit (oscillator) 602 outputting a reference signal based on the oscillation of the crystal oscillator, a frequency division control unit 604 effecting frequency division on the output signal of the oscillation unit 602 to control the operation of a step motor, and a motor drive unit (driver) 606 outputting a motor drive signal for driving the step motor based on the output signal of the frequency division control 604, are contained in an integrated circuit (IC) 654. The integrated circuit consists, for example, of a C-MOS or a PLA. In the case in which the integrated circuit 654 consists of a C-MOS, the oscillation unit 602, the frequency division control unit 604, and the motor drive unit 606 are contained in the integrated circuit 654. In the case in which the integrated circuit (IC) 654 consists of a PLA, the oscillation unit 602, the frequency division control unit 604, and the motor drive unit 606 are operated by a program stored in the PLA.

The crystal oscillator unit 650 and the integrated circuit 654 are fixed to a circuit board 610. The circuit board 610, the crystal oscillator unit 650, and the integrated circuit 654 constitute a circuit block 612. The circuit block 612 is arranged on the case back side of the main plate 402. Further, in the timepiece with a calendar of the present invention, it is possible to use, as needed, external elements such as a resistor, a capacitor, a coil, and a diode. A battery negative terminal 660 is provided to effect conduction between the cathode of the battery 440 and a negative pattern of the circuit board 610. The battery positive terminal 662 is provided to effect conduction between the anode of the battery 440 and a positive pattern of the circuit board 610. A coil block 630 including a coil wire wound around a magnetic core, a stator 632 arranged so as to be in contact with both end portions of the magnetic core of the coil block 630, and a rotor 634 including a rotor magnet 634*b* arranged in a rotor hole 632*c* of the stator 632 are arranged on the case back side of the main plate 402.

The coil block 630, the stator 632, and the rotor 634 constitute a step motor. Through rotation of the rotor 634, a fifth wheel & pinion 441 is rotated. Through the rotation of the fifth wheel & pinion 441, a second wheel & pinion 442 is rotated. Through the rotation of the second wheel & pinion 442, a third wheel & pinion 444 is rotated. Through the rotation of the third wheel & pinion 444, a center wheel & pinion 446 is rotated. Through the rotation of the center wheel & pinion 446, a minute wheel 448 is rotated. Through the rotation of the minute wheel 448, an hour wheel 480 is rotated.

The second wheel & pinion 442 makes one rotation per minute. A second hand 460 is mounted to the second wheel & pinion 442. The center wheel & pinion 446 makes one rotation per hour. A minute hand 462 is mounted to the center wheel & pinion 446. A slip mechanism is provided on the center wheel & pinion 446. When effecting hand matching by the slip mechanism, the winding stem 410 is rotated with the second hand 460 kept at rest, whereby it is possible to rotate the minute hand 462 and an hour hand 464. In order to set the cogwheel portion of the fifth wheel & pinion 441 to stop the rotation of the second hand 460 when performing hand matching with the winding stem 410 drawn out to the second step, there is provided a train wheel setting lever 468.

A central pipe 402*c* is fixed to the main plate 402. The central pipe 402*c* extends from the case back side of the main plate 402 to the dial side of the main plate 402. The center wheel & pinion 446 is rotatably supported in a hole portion of the central pipe 402*c*. A bead of the second wheel & pinion 442 is rotatably supported in a hole portion of the center wheel & pinion 446. A train wheel bridge 458 is arranged on the case back side of the main plate 402. An upper shaft portion of the rotor 634, an upper shaft portion of the fifth wheel & pinion 441, an upper shaft portion of the second wheel & pinion 442, un upper shaft portion of the third wheel & pinion 444, and an upper shaft portion of the minute wheel 448 are rotatably supported by the train wheel bridge 458. A lower shaft portion of the rotor 634, a lower shaft portion of the fifth wheel & pinion 441, a lower shaft portion of the third wheel & pinion 444, and a lower shaft portion of the minute wheel 448 are rotatably supported by the main plate 402.

(1.3) Construction of the Hour Indication Train Wheel

In the following, the construction of an hour indication train wheel will be described. Referring to FIGS. 1, 3 and 21, in the movement 400, the hour wheel 480 includes an hour cogwheel 480*a* and a date feeding cogwheel 480*b*. The hour wheel 480 is formed so as to make one rotation every 12 hours. The hour hand 464 is mounted to the hour wheel 480. Due to the hour hand 464 mounted to the hour wheel 480, "hour" is indicated on the "12-hour system" in which one round makes 12 hours.

(1.4) Construction of Switching Mechanism and Hand Matching Mechanism

Figure 22:
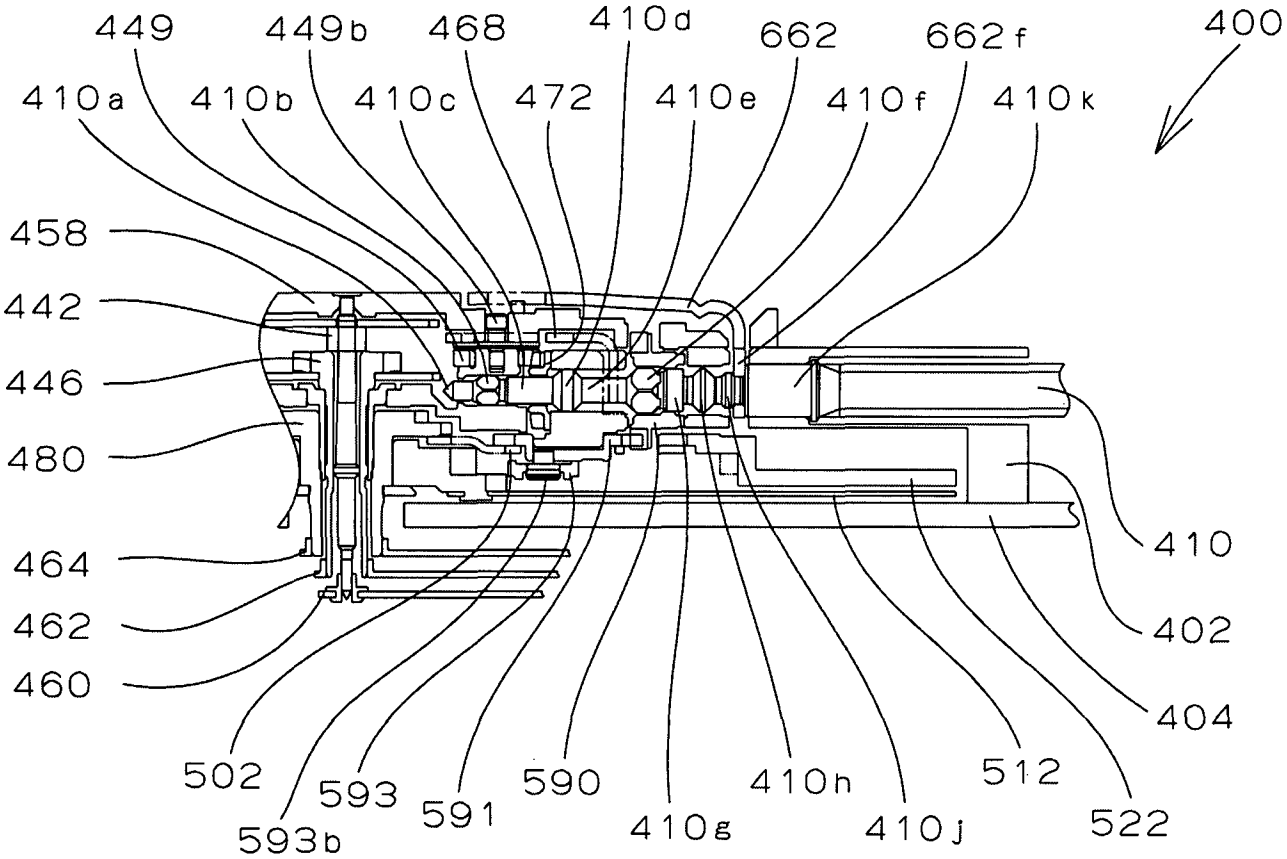
FIG. 22 is a partial sectional view of a timepiece with a calendar mechanism according to an embodiment of the present invention, showing a winding stem, a setting wheel and a portion of a center wheel & pinion.

In the following, the construction of a switching mechanism and a hand matching mechanism will be described. Referring to FIGS. 2 and 22, in the movement 400, the winding stem 410 is rotatably incorporated into the main plate 402. As from the forward end side, the winding stem 410 includes a forward end shaft portion 410*a*, a first corner portion 410*b*, a first shaft portion 410*c*, a setting operation shaft portion 410*d*, a second shaft portion 410*e*, a second corner portion 410*f*, a third shaft portion 410*g*, a first bead portion 410*h*, a second bead portion 410*j*, and a proximal shaft portion 410*k*. The forward end shaft portion 410*a* of the winding stem 410 is rotatably incorporated into a winding stem forward end hole of the main plate 402. The proximal shaft portion 410*k* of the winding stem 410 is rotatably incorporated into a winding stem proximal hole of the main plate 402. The outer diameter of the first bead portion 410*h* is preferably larger than the outer diameter of the second bead portion 410*j*.

The clutch 472 is arranged so as to have the same rotation axis as the rotation axis of winding stem 410. When the winding stem 410 is at the $0^{th}$ step or the $1^{st}$ step, an interlock ratchet of the clutch wheel 472 is rotatable with respect to the first shaft portion 410*c* of the winding stem 410, and the clutch wheel 472 does not rotate even if the winding stem 410 is rotated. When the winding stem 410 is at the $2^{nd}$ step, the interlock ratchet of the clutch wheel 472 is fit-engaged with the first corner portion 410*b* of the winding stem 410, and the clutch wheel 472 rotates based on the rotation of the winding stem 410. When the winding stem 410 is at the $0^{th}$ step, the winding stem positioning portion 662*f* of the battery positive terminal 662 is situated between the proximal shaft portion 410*k* and the second bead portion 410*j*.

When the winding stem 410 is at the $1^{st}$ step, the winding stem positioning portion 662*f* of the battery positive terminal 662 is situated between the first bead portion 410*h* and the second bead portion 410*j*. When the winding stem 410 is at the $2^{nd}$ step, the winding stem positioning portion 662*f* of the battery positive terminal 662 is situated between the first bead portion 410*h* and the third shaft portion 410*g*. Thus, in the switching device constructed as described above, due to the winding stem positioning portion 662*f* of the battery positive terminal 662, positioning can be effected on the winding stem 410 at three axial positions ($0^{th}$ step, $1^{st}$ step, and $2^{nd}$ step).

When the winding stem 410 is at the $0^{th}$ step, and when the winding stem 410 is at the $1^{st}$ step, the train wheel setting lever 468 does not set the cogwheel portion of the fifth wheel & pinion 441, with the setting operation shaft portion 410*d* of the winding stem 410 not being in contact with the train wheel setting lever 468. When the winding stem 410 is at the 2nd step, the train wheel setting lever 468 sets the cogwheel portion of the fifth wheel & pinion 441, with the setting operation shaft portion 410*d* of the winding stem 410 being in contact with the train wheel setting lever 468.

A first calendar corrector wheel 590 is arranged so as to have the same rotation axis as the rotation axis of the winding stem 410. When the winding stem 410 is at the $0^{th}$ step, an interlock crown of the first calendar corrector wheel 590 is rotatable with respect to the third shaft portion 410*g* of the winding stem 410, and, even if the winding stem 410 is rotated, the first calendar corrector wheel 590 does not rotate. When the winding stem 410 is at the $1^{st}$ step, the interlock crown of the first calendar corrector wheel 590 is fit-engaged with the second corner portion 410*f* of the winding stem 410, and the first calendar corrector wheel 590 rotates based on the rotation of the winding stem 410. When the winding stem 410 is at the $2^{nd}$ step, the interlock crown of the first calendar corrector wheel 590 is rotatable with respect to the second shaft portion 410*e* of the winding stem 410, and, even if the winding stem 410 is rotated, the first calendar corrector wheel 590 does not rotate.

A minute cogwheel 448*a* of the minute wheel 448 is arranged so as to be in mesh with a setting wheel 449. The setting wheel 449 is arranged between the main plate 402 and the train wheel bridge 458. A minute pinion (not shown) of the minute wheel 448 is situated on the dial side of the main plate 402 and held in mesh with an hour cogwheel 480*a* of the hour wheel 480. The hole portion of the hour wheel 480 is rotatably supported by the outer peripheral portion of the shaft portion of the central pipe 402*c*.

(1.5) Construction of First Date Indicator Feeding Mechanism

In the following, the construction of a first date indicator feeding mechanism will be described. Referring to FIGS. 1 through 4 and 21, in the movement 400, the date feeding mechanism includes a date indicator driving wheel 510 and a first date jumper 514. The date indicator driving wheel 510 includes a date indicator driving cogwheel 510*c* and a date finger 510*d*. The date feeding cogwheel 480*b* of the hour wheel 480 is in mesh with the date indicator driving cogwheel 510*c*. Through rotation of the hour wheel 480, the date indicator driving wheel 510 makes one rotation every 24 hours. A first date indicator 512 is rotatably incorporated into the main plate 402. The first date jumper 514 is incorporated into the main plate 402. The first date jumper 514 includes a spring portion 514*bb*, and setting portions 514*c* and 514*d* provided at the forward ends of the spring portion. The setting portions 514*c* and 514*d* of the first date jumper 514 set the tooth portions of the first date indicator 512. Through the rotation of the date indicator driving wheel 510, the first date indicator 512 rotates once a day by one pitch (tooth).

(1.6) Construction of Calendar Mechanism (1.6.1) Construction of First Date Indicator and Second Date Indicator In the following, the construction of the calendar mechanism of the timepiece with a calendar mechanism of the present invention will be described.

(A) Arrangement of Calendar Mechanism

Figure 4:
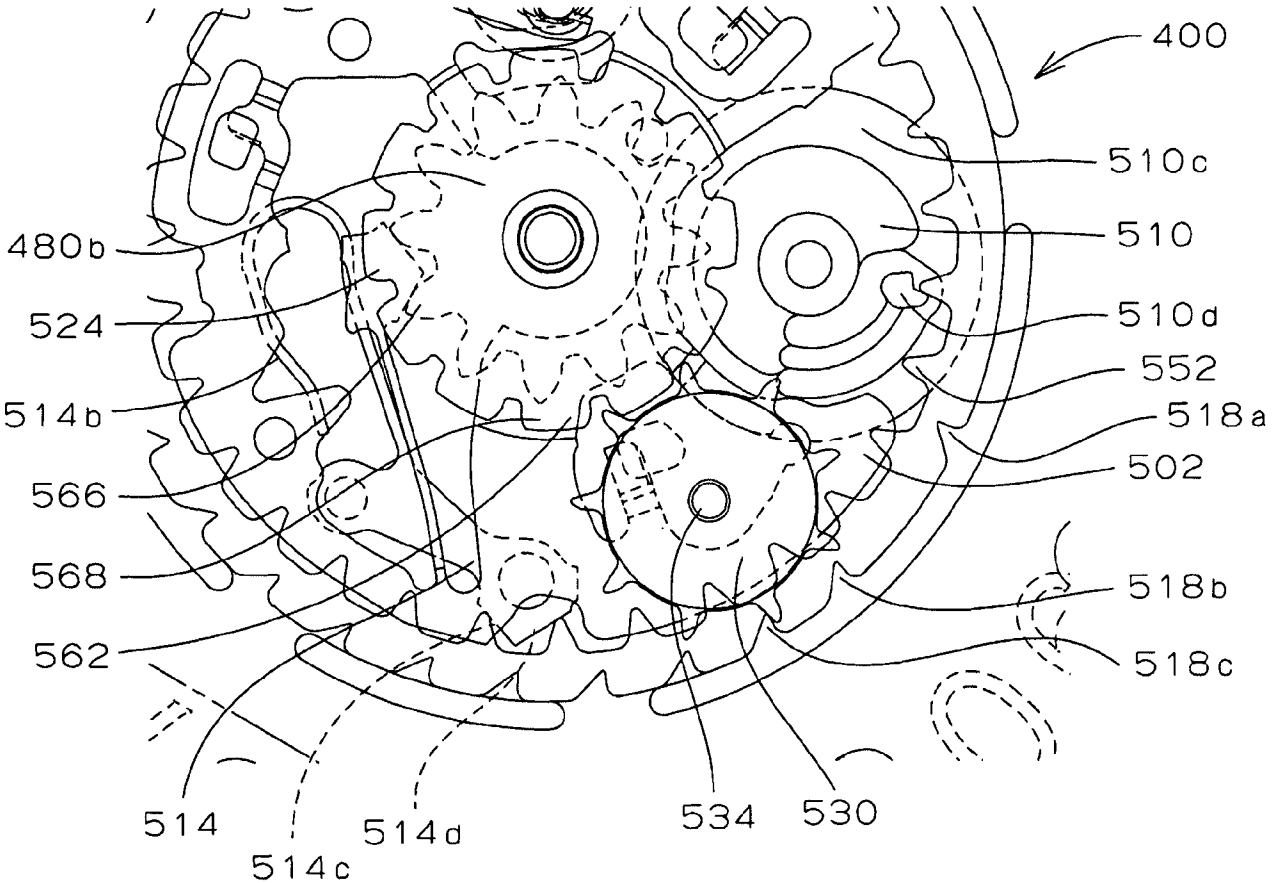
FIG. 4 is an enlarged partial plan view, as seen from the dial side, of a part of the calendar mechanism of a movement in a timepiece with a calendar mechanism according to an embodiment of the present invention.

FIG. 4 is a partial plan view, as seen from the dial side, of the structure of the back side of the movement 400 in the timepiece with a calendar mechanism of the present invention in a state in which the first date indicator 512 is starting to be rotated in the normal direction (counterclockwise). Referring to FIGS. 3, 4 and 21, the movement 400 is equipped with the date indicator driving wheel 510 rotated through rotation of the hour wheel 480, the first date indicator 512 indicating the one place of a date, the first date jumper 514 for setting the position in the rotating direction of the first date indicator 512, a second date indicator 522 indicating the ten place of a date, a second date jumper 524 for setting the position in the rotating direction of the second date indicator 522, and an intermediate date wheel 530 capable of rotating based on the rotation of the first date indicator 512 to rotate the second date indicator 522.

The first date indicator 512 is provided so as to be rotatable with respect to the main plate 402. The second date indicator 522 is provided so as to be rotatable with respect to the hour wheel 480. The rotation center of the first date indicator 512 and the rotation center of the second date indicator 522 are situated at the same position (i.e., the first and second date indicators are in superposed and concentric relationship relative one another). That is, the rotation center of the first date indicator 512 and the rotation center of the second date indicator 522 are situated at the same position as the rotation center of the hour hand 464 (i.e., the rotation center of the hour wheel 480). The intermediate date wheel 530 is provided so as to be rotatable with respect to an intermediate date wheel pin 534 fixed to the date indicator maintaining plate 502. The setting portions 514*c* and 514*d* of the first date jumper 514 set the tooth portions of the first date indicator 512.

(B) When the Date Window is Arranged at the 12 O'Clock Position

Figure 5:
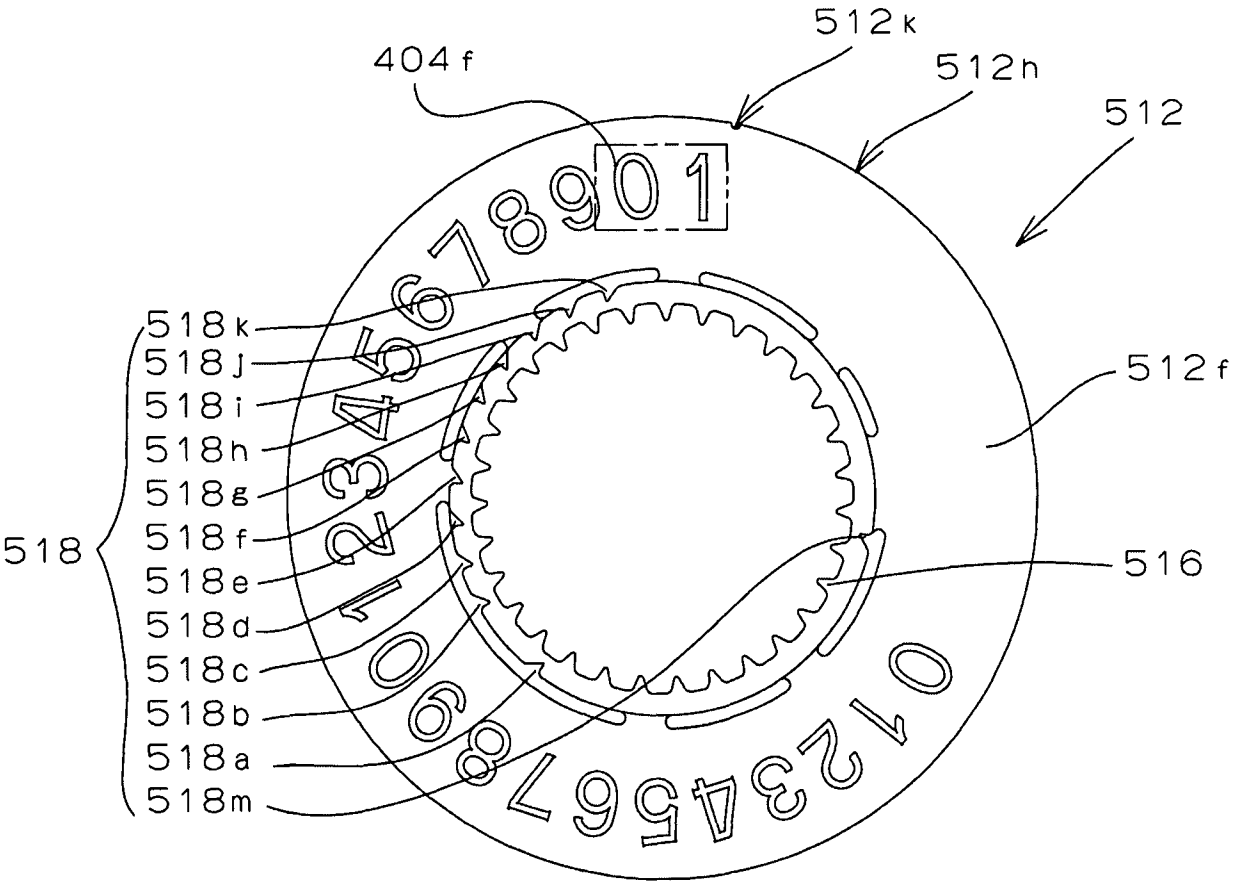
FIG. 5 is a plan view of a first date indicator in a construction in which a date window is arranged in the 12 o'clock direction of the dial in a timepiece with a calendar mechanism according to an embodiment of the present invention.

Referring to FIG. 5, in the case of the construction in which a date window 404*f* is formed at the 12 o'clock position of the dial 404, the first date indicator 512 is equipped with a ring-shaped first date letter display surface 512*f*. The first date indicator 512 includes 31 first date indicator tooth portions 516 formed as inner teeth, and 12 calendar feeding teeth 518 formed as inner teeth. The diameter of the tooth tip circle of the first date indicator tooth portions 516 is smaller than the diameter of the tooth tip circle of the calendar feeding teeth 518. The first date indicator tooth portions 516 are formed at equal angular intervals, that is, at an intervals of (360/31) degrees.

The calendar feeding teeth 518 include 10 calendar feeding teeth formed at an angular interval of (360/31) degrees, that is, a first calendar feeding tooth 518*b* through a tenth calendar feeding tooth 518*k*, an eleventh calendar feeding tooth 518*m* formed at an angular interval of (360*10/31) degrees in a first direction (i.e., clockwise) opposite to the direction in which the first calendar feeding tooth 518*b* is arranged, using the tenth calendar feeding tooth 518*k* as a reference, and a twelfth calendar feeding tooth (518*a*) formed at an angular interval of (360*10/31) degrees in the first direction (i.e., clockwise), using the eleventh calendar feeding tooth 518*m* as a reference.

First date letters (characters) 512*h* consisting of a sequence of 22 numbers are provided on the first date letter (character) display surface 512*f*. That is, the first date letters 512*h* include 22 numbers of "0", "1", "2", "3", "4", "5", "6", "7", "8", "9" (first sequence of numbes), "0", "1", "2", "3", "4", "5", "6", "7", "8", "9" (second sequence of numbers), "0" and "1" (third sequence of numbers). The 22 numbers constituting the first date letters 512*h* are arranged on the first date letter display surface 512*f* at equal intervals, i.e., at an interval of (360/31) degrees. Between the first number "1" and the last number "0", there exists a portion where nothing is displayed. The portion where nothing is displayed is arranged on the first date letter display surface 512*f* at an interval of (360*9/31) degrees. In the state shown in FIG. 5, the numbers "0" and "1" are arranged under the date window 404*f* provided in the dial 404. In the outer peripheral portion of the first date display surface 512*f*, a cutout portion 512*k* is formed so as to correspond to the position between the portion where nothing is displayed and the number "1". It is possible to display management symbols such as the year and month of manufacture, country of manufacture, and destination on the portion where nothing is displayed.

Figure 6:
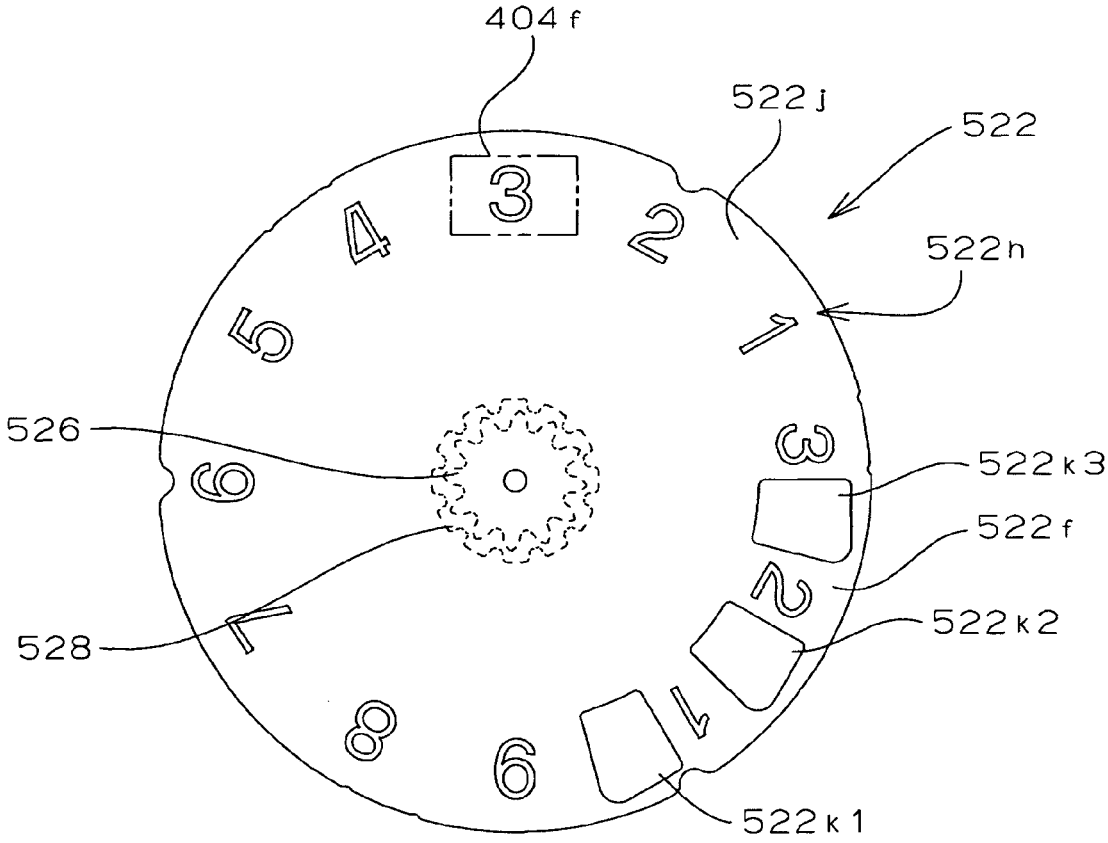
FIG. 6 is a plan view of a second date indicator in a construction in which a date window is arranged in the 12 o'clock direction of the dial in a timepiece with a calendar mechanism according to an embodiment of the present invention.

Referring to FIG. 6, the second date indicator 522 is provided with a disc-like second date letter (character) display surface 522*f* (second display surface) equipped with three window portions. Further, the second date indicator 522 includes 12 positioning tooth portions 526 formed as outer teeth, and 12 feeding teeth 528 formed as outer teeth. The positioning tooth portions 526 are formed at equal angular intervals, e.g., an interval of (360/12) degrees. The feeding teeth 528 are formed at equal angular intervals, e.g., an interval of (360/12) degrees.

The second date indicator 522 has the second date letter display surface 522*f*. On the second date letter display surface 522*f*, there are provided, at equal angular intervals, the a first sequence of numbers "1", "2", "3", "4", "5", "6", "7", "8" and "9" for singly indicating a one-digit date, and a second sequence of numbers of "1" "2" and "3" for indicating the ten place of a date. A window portion (first window portion) 522*k*2 is formed between the number "1" for indicating the ten place and the number "2" for indicating the ten place. A window portion 522*k*3 (second window portions) is formed between the number "2" for indicating the ten place and the number "3" for indicating the ten place. A window portion 522*k*1 (third window portions) is formed between the number "1" for indicating the ten place and the number "9" for singly indicating a one-digit date. The number "1" for indicating the ten place, the number "2" for indicating the ten place, and the number "3" for indicating the ten place are formed at equal angular intervals. The window portion 522*k*1 and the window portion 522*k*2 are formed at an interval, for example, of (360/12) degrees. The window portion 522*k*2 and the window portion 522*k*3 are formed at an interval, for example, of (360/12) degrees.

The number "1" for indicating the ten place, the number "2" for indicating the ten place, and the number "3" for indicating the ten place, are formed at equal angular intervals, for example, (360/12) degrees. The center of the window portion 522*k*1 and the center of the window portion 522*k*2 are spaced apart from each other by a distance, for example, of (360/12) degrees. The center of the window portion 522*k*2 and the center of the window portion 522*k*3 are spaced apart from each other by a distance, for example, of (360/12) degrees. The center of the number "1" for singly displaying a one-digit date and the center of the window portion 522*k*3 are spaced apart from each other by a distance, for example, of 37.5 degrees. The center of the number "9" for singly displaying a one-digit date and the center of the window portion 522*k*1 are spaced apart from each other by a distance, for example, of 22.5 degrees. The center of the number "1" for indicating the ten place and the center of the number "9" for singly displaying a one-digit date are spaced apart from each other by a distance, for example, of 37.5 degrees. The center of the number "1" for indicating the ten place and the center of the number "2" for indicating the ten place are spaced apart from each other by a distance, for example, of (360/12) degrees. The center of the number "2" for indicating the ten place and the center of the number "3" for indicating the ten place are spaced apart from each other by a distance, for example, of (360/12) degrees. Instead of forming a window portion, it is also possible to form, in the second date letter display surface 522*f*, a cutout portion having a similar configuration. Alternatively, instead of forming a window portion, it is also possible to form the second date letter display surface 522*f* of a transparent material (e.g., a transparent plastic such as acrylic resin), and to maintain a configuration similar to that of the window portion in a transparent state, allowing printing of numbers. In this construction, it is possible to print the second date letter display surface 522*f* except for the window portion on a white background, printing the numbers in black letters.

In the movement, under the window portion of the second date indicator 522, it is possible to arrange one of the numbers of the first date letter display surface 512*f* of the first date indicator 512. On the second date letter display surface 522*f*, there are provided the numbers of "1", "2", "3", "4", "5", "6", "7", "8" and "9" for singly displaying a one-digit date, and the numbers of "1", "2" and "3" for displaying the ten place of a date. In the state shown in FIG. 6, of the second date letters (characters) 522*h*, the number "3" for singly displaying a one-digit date is arranged so as to be in correspondence with the date window 404*f* provided in the dial 404.

Figure 7:
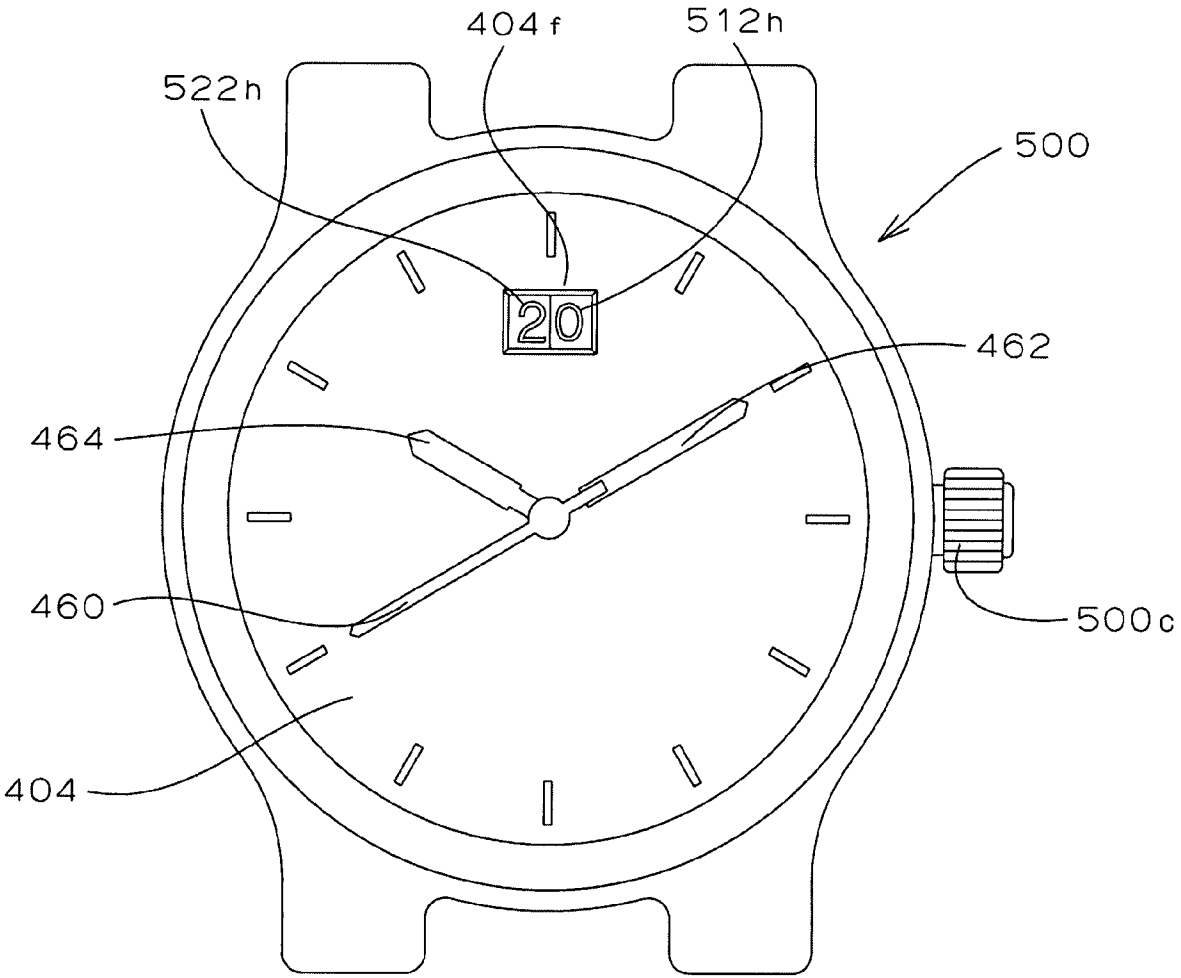
FIG. 7 is a plan view of a construction in which a date window is arranged in the 12 o'clock direction of the dial in a timepiece with a calendar mechanism according to an embodiment of the present invention, showing a state in which a complete indicates "$20^{th}$ day"

The second date letter display surface 522*f* is arranged at a position nearer to the dial 404 than the first date letter display surface 512*f*. Referring to FIG. 7, in a complete 500 of the timepiece with a calendar mechanism of the present invention, the date window 404*f* is formed at the 12 o'clock position of the dial 404. In the complete 500, in the left-hand side portion of the date window 404*f* of the dial 404, the number "2" of the second date letters 522*h* of the second date indicator 522 is arranged, and, in the right-hand side portion of the date window 404*f*, the number "0" of the first date letters 512*h* of the first date indicator 512 is arranged. Thus, the complete 500 indicates "20", that is, "20$^{th}$" day.

Figure 8:
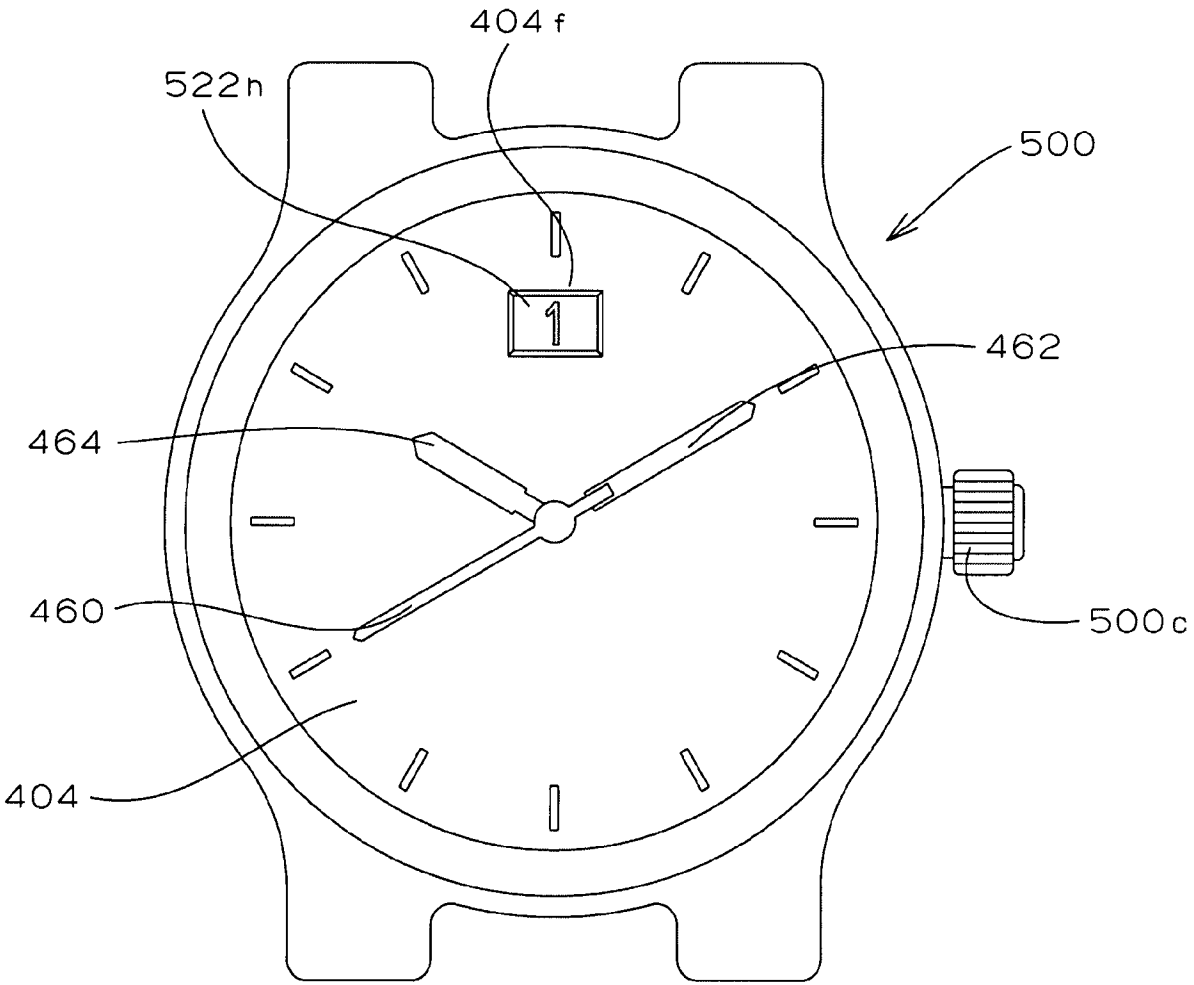
FIG. 8 is a plan view of a construction in which a date window is arranged in the 12 o'clock direction of the dial in a timepiece with a calendar mechanism according to an embodiment of the present invention, showing a state in which a complete indicates "$1^{st}$ day"

Referring to FIG. 8, in the complete 500 of the timepiece with a calendar mechanism of the present invention, the date window 404*f* is formed at the 12 o'clock position of the dial 404. In the complete 500, in the date window 404*f* portion of the dial 404, there is arranged, of the second date letters 522*h* of the second date indicator 522, the number "1" for singly indicating a one-digit date. Thus, the complete 500 indicates "1", that is, "1$^{st}$" day. In this state, in the date window 404*f* portion of the dial 404, there is arranged the portion where nothing is displayed of the first date letter display surface 512*f* of the first date indicator 512. In this construction, the area that can be occupied by the second date letter indicating "1" can be (31/12) times, i.e., approximately 2.6 times, as large as that of the conventional calendar mechanism in a movement of the same size.

(C) When the Date Window is Arranged at the 6 O'Clock Position

Figure 9:
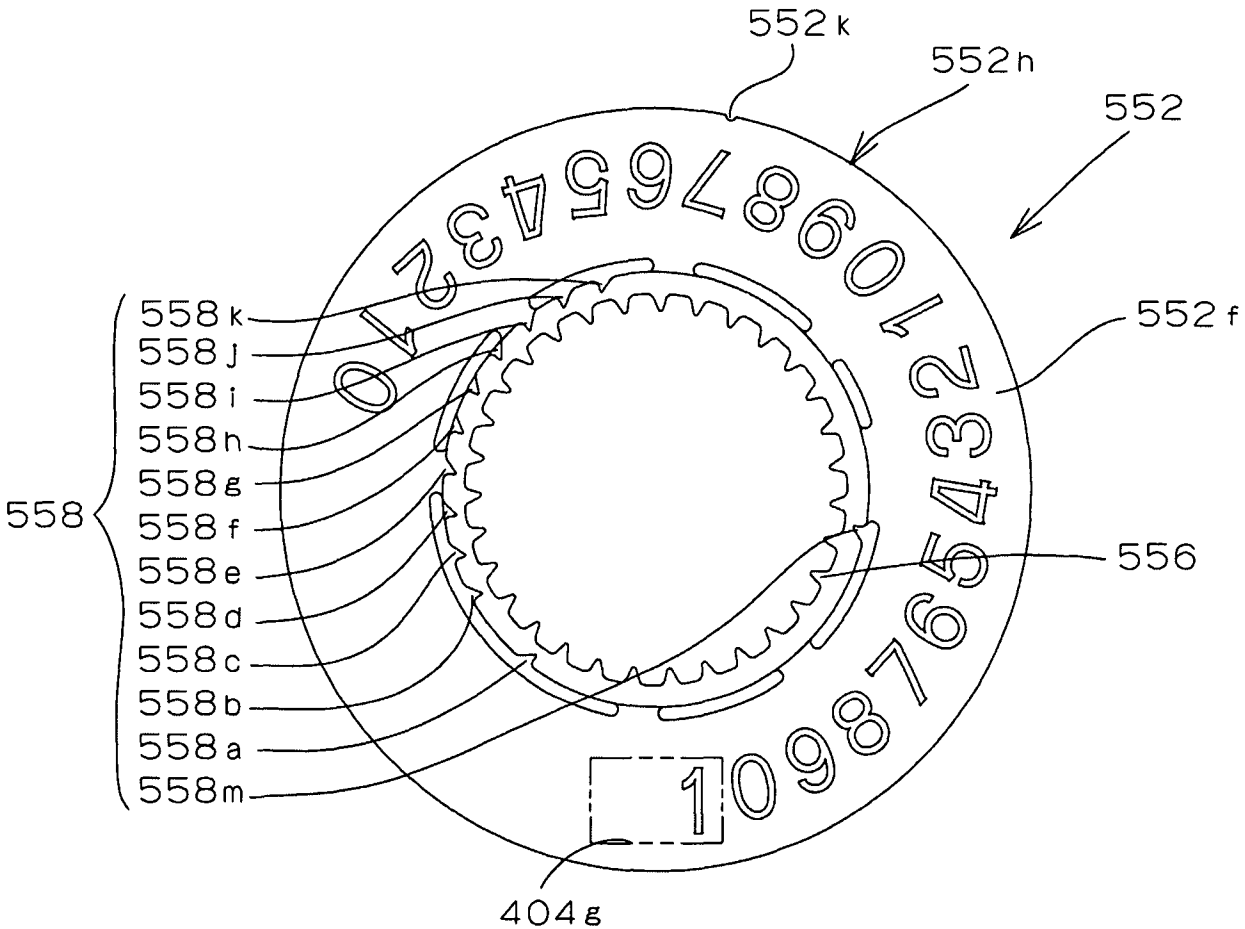
FIG. 9 is a plan view of a first date indicator in a construction in which a date window is arranged in the 6 o'clock direction of the dial in a timepiece with a calendar mechanism according to an embodiment of the present invention.

Referring to FIG. 9, in the case of a construction in which a date window 404*g* is formed at the 6 o'clock position of the dial 404, a first date indicator 552 is equipped with a ring-shaped first date letter display surface 552*f*. The first date indicator 552 includes 31 first date indicator tooth portions 556 formed as inner teeth, and 12 calendar feeding teeth 558 formed as inner teeth. The first date indicator tooth portions 556 are formed at equal intervals, that is, at an interval of (360/31) degrees. The calendar feeding teeth 558 include 10 calendar feeding teeth formed at an angular interval of (360/31) degrees, that is, a first calendar feeding tooth 558*b* through a tenth calendar feeding tooth 558*k*, an eleventh calendar feeding tooth 558*m* formed at an angular interval of (360*10/31) degrees in a first direction (i.e., clockwise) opposite to the direction in which the first calendar feeding tooth 558*b* is arranged, using the tenth calendar feeding tooth 558*k* as a reference, and a twelfth calendar feeding tooth (558*a*) formed at an angular interval of (360*10/31) degrees in the first direction (i.e., clockwise), using the eleventh calendar feeding tooth 558*m* as a reference.

First date letters 552*h* consisting of 22 numbers are provided on the first date letter display surface 552*f*. That is, the first date letters 552*h* include 22 numbers of "0", "1", "2", "3", "4", "5", "6", "7", "8", "9", "0", "1", "2", "3", "4", "5", "6", "7", "8", "9", "0" and "1". The 22 numbers constituting the first date letters 552*h* are arranged on the first date letter display surface 552*f* at equal intervals, i.e., at an interval of (360/31) degrees. Between the first number "1" and the last number "0", there exists a portion where nothing is displayed. The portion where nothing is displayed is arranged on the first date letter display surface 552*f* at an interval of (360*9/31) degrees. In the state shown in FIG. 9, the portion where nothing is displayed and the number "1" is arranged under the date window 404*g* provided in the dial 404. In the outer peripheral portion of the first date display surface 552*f*, a cutout portion 552*k* is formed so as to correspond to the position between the numbers "6" and "7". It is possible to display management symbols such as the year and month of manufacture, country of manufacture, and destination on the portion where nothing is displayed.

Figure 10:
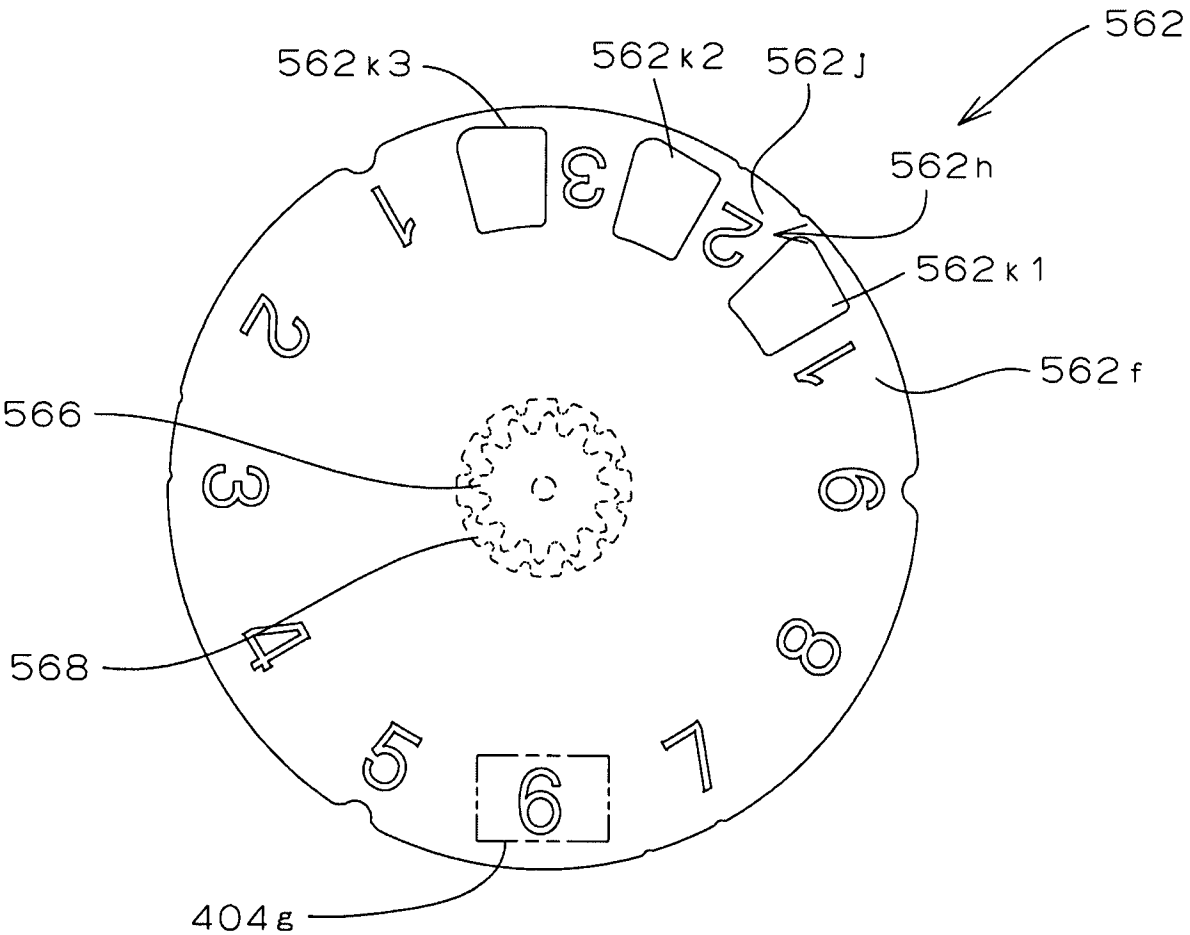
FIG. 10 is a plan view of a second date indicator in a construction in which a date window is arranged in the 6 o'clock direction of the dial in a timepiece with a calendar mechanism according to an embodiment of the present invention.

Referring to FIG. 10, a second date indicator 562 is provided with a disc-like second date letter display surface 562*f* equipped with three window portions. Further, the second date indicator 562 includes 12 positioning tooth portions 566 formed as outer teeth, and 12 feeding teeth 568 formed as outer teeth. The positioning tooth portions 566 are formed at equal angular intervals, e.g., an interval of (360/12) degrees. The feeding teeth 568 are formed at equal angular intervals, e.g., an interval of (360/12) degrees.

The second date indicator 562 has the second date letter display surface 562*f*. On the second date letter display surface 562*f*, there are provided, at equal angular intervals, the numbers of "1", "2", "3", "4", "5", "6", "7", "8" and "9" for singly indicating a one-digit date, and the numbers of "1", "2" and "3" for indicating the ten place of a date. A window portion 562*k*1 is formed between the number "1" for indicating the ten place and the number "2" for indicating the ten place. A window portion 562*k*2 is formed between the number "2" for indicating the ten place and the number "3" for indicating the ten place. A window portion 562*k*3 is formed between the number "3" for indicating the ten place and the number "1" for singly indicating a one-digit date. The number "1" for indicating the ten place, the number "2" for indicating the ten place, and the number "3" for indicating the ten place are formed at equal angular intervals. The window portion 562*k*1 and the window portion 562*k*2 are formed at an interval, for example, of (360/12) degrees. The window portion 562*k*2 and the window portion 562*k*3 are formed at an interval, for example, of (360/12) degrees.

Instead of forming a window portion, it is also possible to form, in the second date letter display surface 562*f*, a cutout portion having a similar configuration. Alternatively, instead of forming a window portion, it is also possible to form the second date letter display surface 562*f* of a transparent material (e.g., a transparent plastic such as acrylic resin), and to maintain a configuration similar to that of the window portion in a transparent state, allowing printing of numbers. In this construction, it is possible to print the second date letter display surface 562*f* except for the window portion on a white background, printing the numbers in black letters.

In the movement, under the window portion of the second date indicator 562, it is possible to arrange one of the numbers of the first date letter display surface 552*f* of the first date indicator 552. On the second date letter display surface 562*f*, there are provided the numbers of "1", "2", "3", "4", "5", "6", "7", "8" and "9" for singly displaying a one-digit date, and the numbers of "1", "2" and "3" for displaying the ten place of a date. In the state shown in FIG. 10, of second date letters 562*h*, the number "6" for singly displaying a one-digit date is arranged so as to be in correspondence with the date window 404*g* provided in the dial 404.

Figure 11:
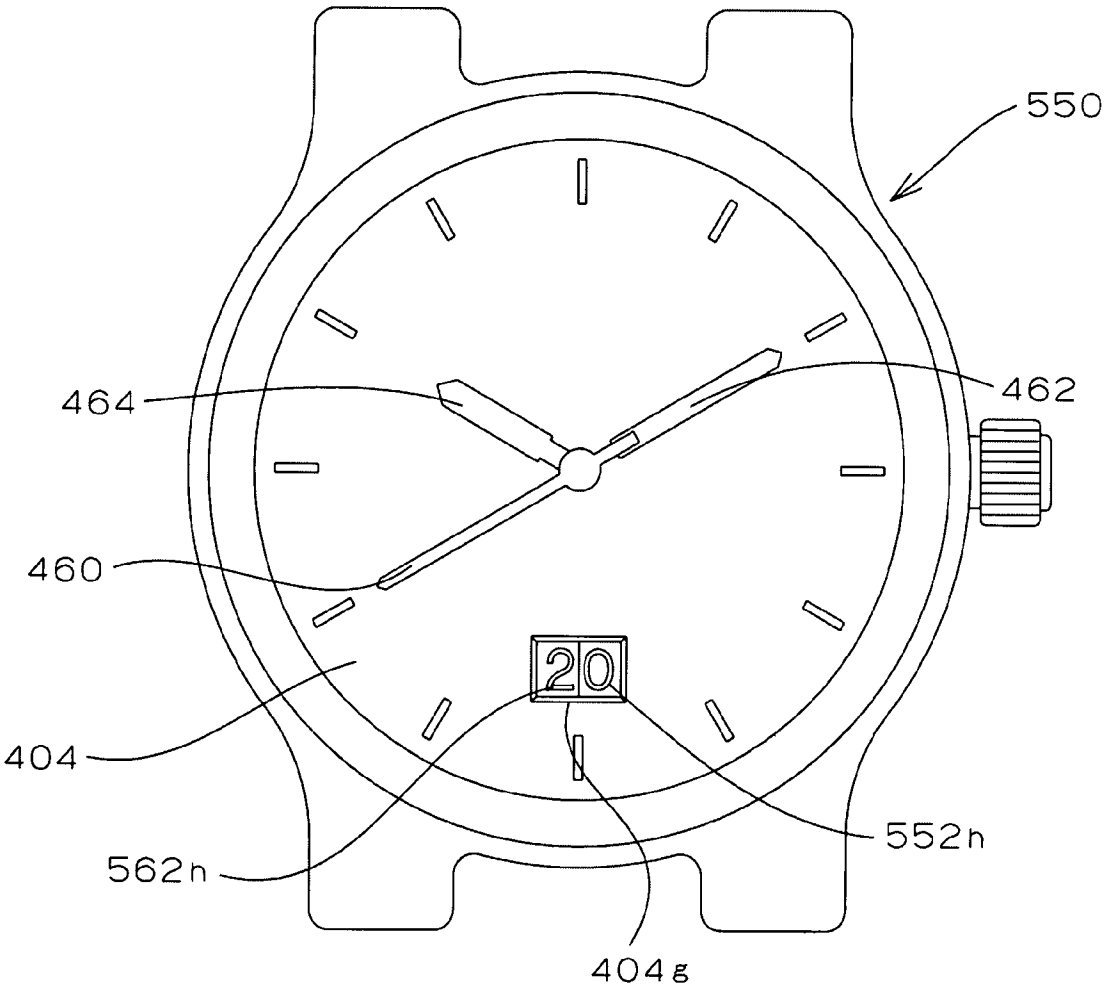
FIG. 11 is a plan view of a construction in which a date window is arranged in the 6 o'clock direction of the dial in a timepiece with a calendar mechanism according to an embodiment of the present invention, showing a state in which a complete indicates "$20^{th}$ day"

Referring to FIG. 11, in a complete 550 of the timepiece with a calendar mechanism of the present invention, the date window 404*g* is formed at the 6 o'clock position of the dial 404. In the complete 550, in the left-hand side portion of the date window 404*g* of the dial 404, the number "2" of the second date letters 562*h* of the second date indicator 562 is arranged, and, in the right-hand side portion of the date window 404*g*, the number "0" of the first date letters 552*h* of the first date indicator 552 is arranged. Thus, the complete 550 indicates "20", that is, "$20^{th}$" day.

Figure 12:
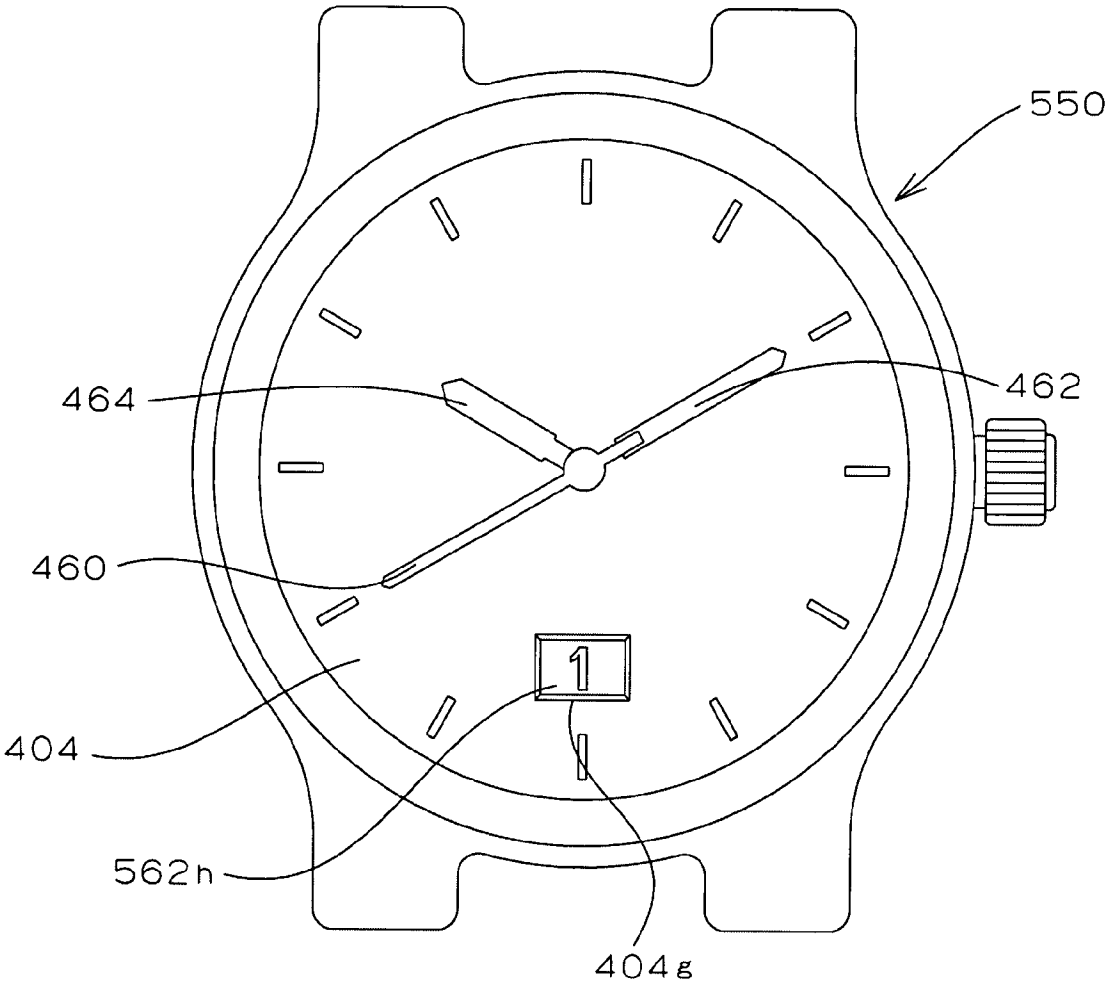
FIG. 12 is a plan view of a construction in which a date window is arranged in the 6 o'clock direction of the dial in a timepiece with a calendar mechanism according to an embodiment of the present invention, showing a state in which a complete indicates "$1^{st}$ day"

Referring to FIG. 12, in the complete 550 of the timepiece with a calendar mechanism of the present invention, the date window 404*g* is formed at the 6 o'clock position of the dial 404. In the complete 550, in the date window 404*g* portion of the dial 404, there is arranged, of the second date letters 562*h* of the second date indicator 562, the number "1" for singly indicating a one-digit date. Thus, the complete 550 indicates "1", that is, "$1^{st}$" day. In this state, in the date window 404*g* portion of the dial 404, there is arranged the portion where nothing is displayed of the first date letter display surface 552*f* of the first date indicator 552. In this construction, the area that can be occupied by the second date letter indicating "1" can be (31/12) times, i.e., approximately 2.6 times, as large as that of the conventional calendar mechanism in a movement of the same size.

(D) When the Date Window is Arranged at the 3 O'Clock Position

Figure 13:
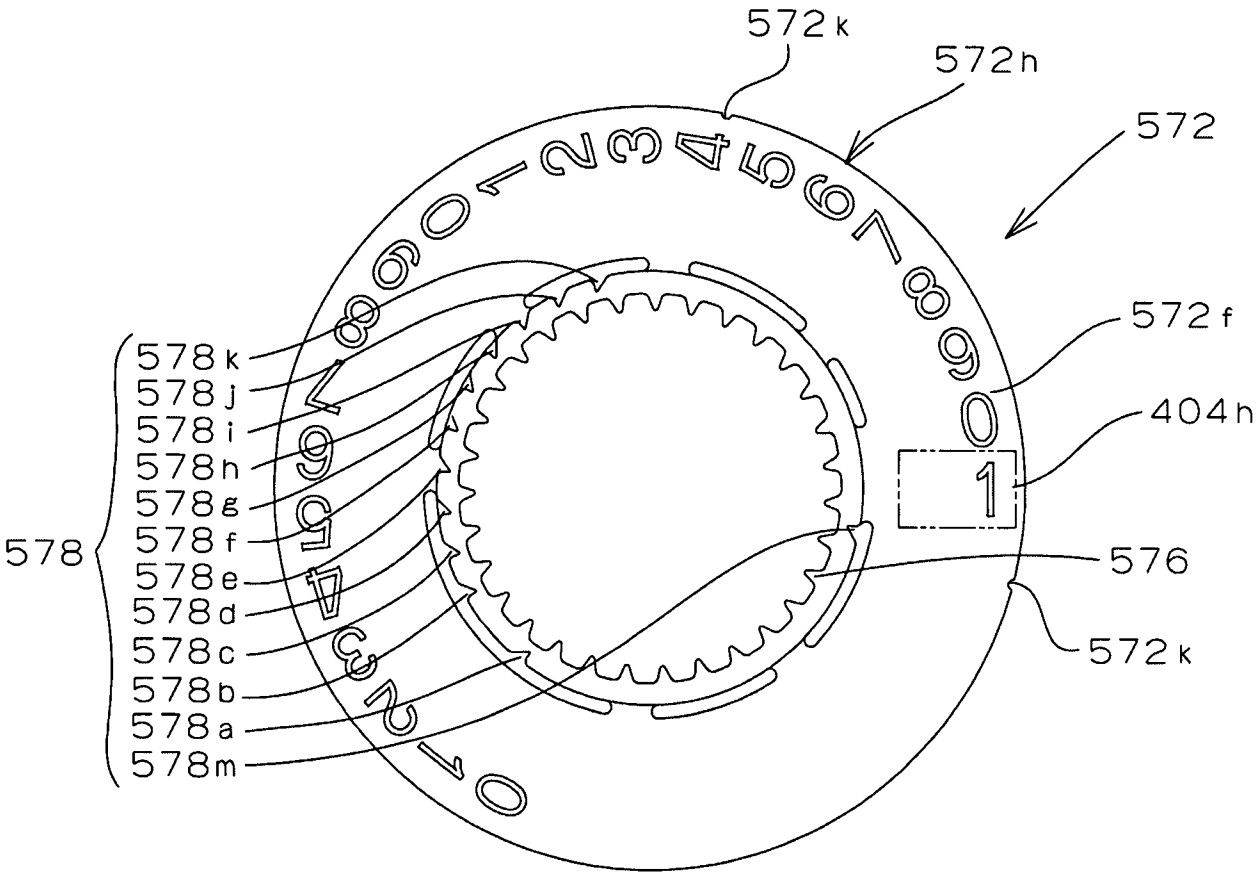
FIG. 13 is a plan view of a first date indicator in a construction in which a date window is arranged in the 3 o'clock direction of the dial in a timepiece with a calendar mechanism according to an embodiment of the present invention.

Referring to FIG. 13, in the case of a construction in which a date window 404*h* is formed at the 3 o'clock position of the dial 404, a first date indicator 572 is equipped with a ring-shaped first date letter display surface 572*f*. The first date indicator 572 includes 31 first date indicator tooth portions 576 formed as inner teeth, and 12 calendar feeding teeth 578 formed as inner teeth. The first date indicator tooth portions 576 are formed at equal intervals, that is, at an interval of (360/31) degrees.

The calendar feeding teeth 578 include 10 calendar feeding teeth formed at an angular interval of (360/31) degrees, that is, a first calendar feeding tooth 578*b* through a tenth calendar feeding tooth 578*k*, an eleventh calendar feeding tooth 578*m* formed at an angular interval of (360*10/31) degrees in a first direction (i.e., clockwise) opposite to the direction in which the first calendar feeding tooth 578*b* is arranged, using the tenth calendar feeding tooth 578*k* as a reference, and a twelfth calendar feeding tooth (578*a*) formed at an angular interval of (360*10/31) degrees in the first direction (i.e., clockwise), using the eleventh calendar feeding tooth 578*m* as a reference.

First date letters 572*h* consisting of 22 numbers are provided on the first date letter display surface 572*f*. That is, the first date letters 572*h* include 22 numbers of "0", "1", "2", "3", "4", "5", "6", "7", "8", "9", "0", "1", "2", "3", "4", "5", "6", "7", "8", "9", "0" and "1". The 22 numbers constituting the first date letters 572*h* are arranged on the first date letter display surface 572*f* at equal intervals, i.e., at an interval of (360/31) degrees. Between the first number "1" and the last number "0", there exists a portion where nothing is displayed. The portion where nothing is displayed is arranged on the first date letter display surface 572*f* at an interval of (360*9/31) degrees. In the state shown in FIG. 13, the number "1" is arranged under the date window 404*h* provided in the dial 404. In the outer peripheral portion of the first date display surface 512*f*, a cutout portion 572*k* is formed so as to correspond to the position between the numbers "4" and "5". It is possible to display management symbols such as the year and month of manufacture, country of manufacture, and destination on the portion where nothing is displayed.

Figure 14:
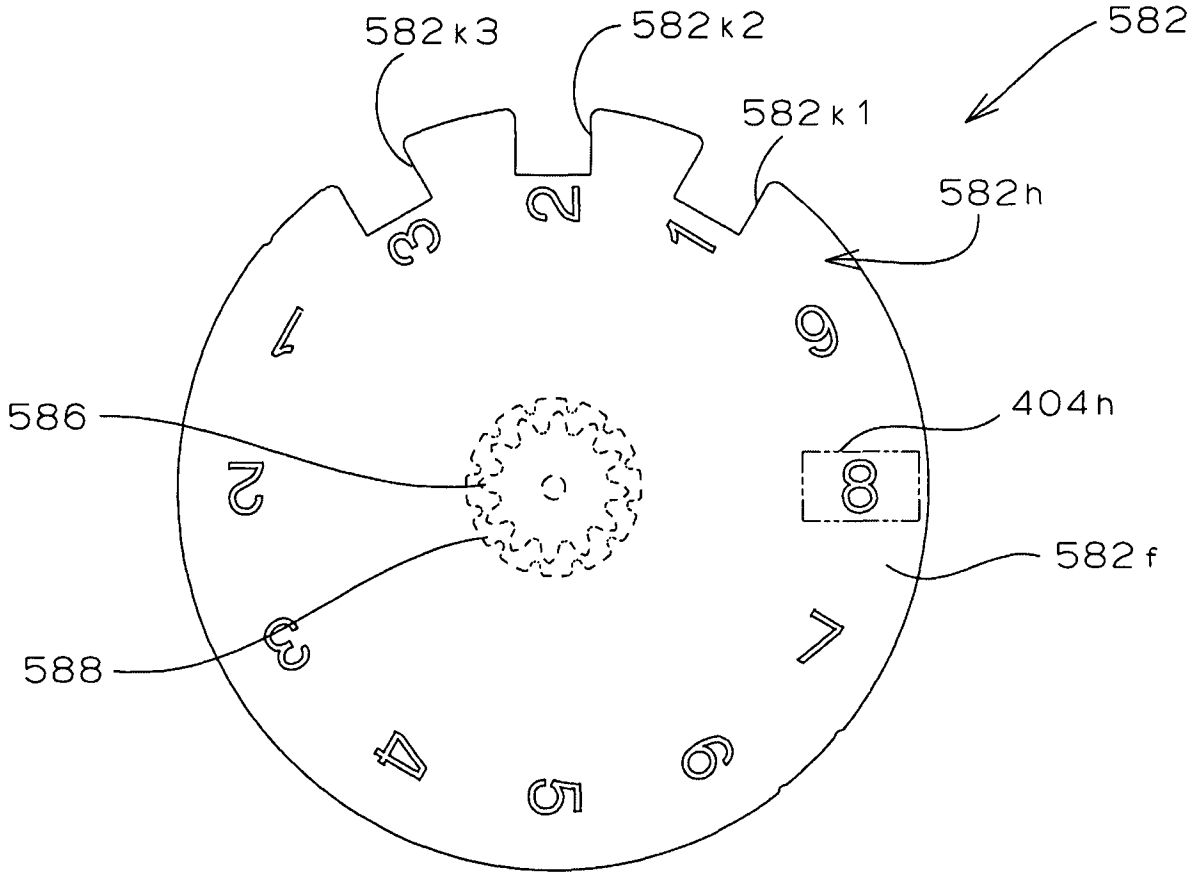
FIG. 14 is a plan view of a second date indicator in a construction in which a date window is arranged in the 3 o'clock direction of the dial in a timepiece with a calendar mechanism according to an embodiment of the present invention.

Referring to FIG. 14, a second date indicator 582 is provided with a disc-like second date letter display surface 582*f*. The outer diameter of the second date letter display surface 582*f* is smaller than the size of the region where the date letters of the first date letter display surface 572*f* are arranged. The second date indicator 582 includes 12 positioning tooth portions 586 formed as outer teeth, and 12 feeding teeth 588 formed as outer teeth. The positioning tooth portions 586 are formed at equal angular intervals, e.g., an interval of (360/12) degrees. The feeding teeth 588 are formed at equal angular intervals, e.g., an interval of (360/12) degrees.

The second date indicator 582 has the second date letter display surface 582*f*. On the second date letter display surface 582*f*, there are provided, at equal angular intervals, the numbers of "1", "2", "3", "4", "5", "6", "7", "8" and "9" for singly indicating a one-digit date, and the numbers of "1", "2" and "3" for indicating the ten place of a date. A cutout portion 582*k*1 is formed on the outer side of the number "1" for indicating the ten place. A cutout portion 582*k*2 is formed on the outer side of the number "2" for indicating the ten place. A cutout portion 582*k*3 is formed on the outer side of the number "3" for indicating the ten place. The number "1" for indicating the ten place, the number "2" for indicating the ten place, and the number "3" for indicating the ten place, are formed at equal angular intervals. The window portion 582*k*1 and the window portion 582*k*2 are formed at an interval, for example, of (360/12) degrees. The window portion 582*k*2 and the window portion 582*k*3 are formed at an interval, for example, of (360/12) degrees.

The number "1" for indicating the ten place, the number "2" for indicating the ten place, and the number "3" for indicating the ten place, are formed at equal angular intervals, e.g., at an interval of (360/12) degrees. Instead of forming a cutout portion, it is also possible to form, in the second date letter display surface 582*f*, a window portion having a similar configuration. Alternatively, instead of forming a cutout portion, it is also possible to form the second date letter display surface 582*f* of a transparent material (e.g., a transparent plastic such as acrylic resin), and to maintain a configuration similar to that of the cutout portion in a transparent state, allowing printing of numbers. In this construction, it is possible to print the second date letter display surface 582*f* except for the cutout portion on a white background, printing the numbers in black letters.

In the movement, under the cutout portion of the second date indicator 582, it is possible to arrange one of the numbers of the first date letter display surface 572*f* of the first date indicator 572. On the second date letter display surface 582*f*, there are provided the numbers of "1", "2", "3", "4", "5", "6", "7", "8" and "9" for singly displaying a one-digit date, and the numbers of "1", "2" and "3" for displaying the ten place of a date. In the state shown in FIG. 14, of second date letters 582*h*, the number "8" for singly displaying a one-digit date is arranged so as to be in correspondence with the date window 404*h* provided in the dial 404.

Figure 15:
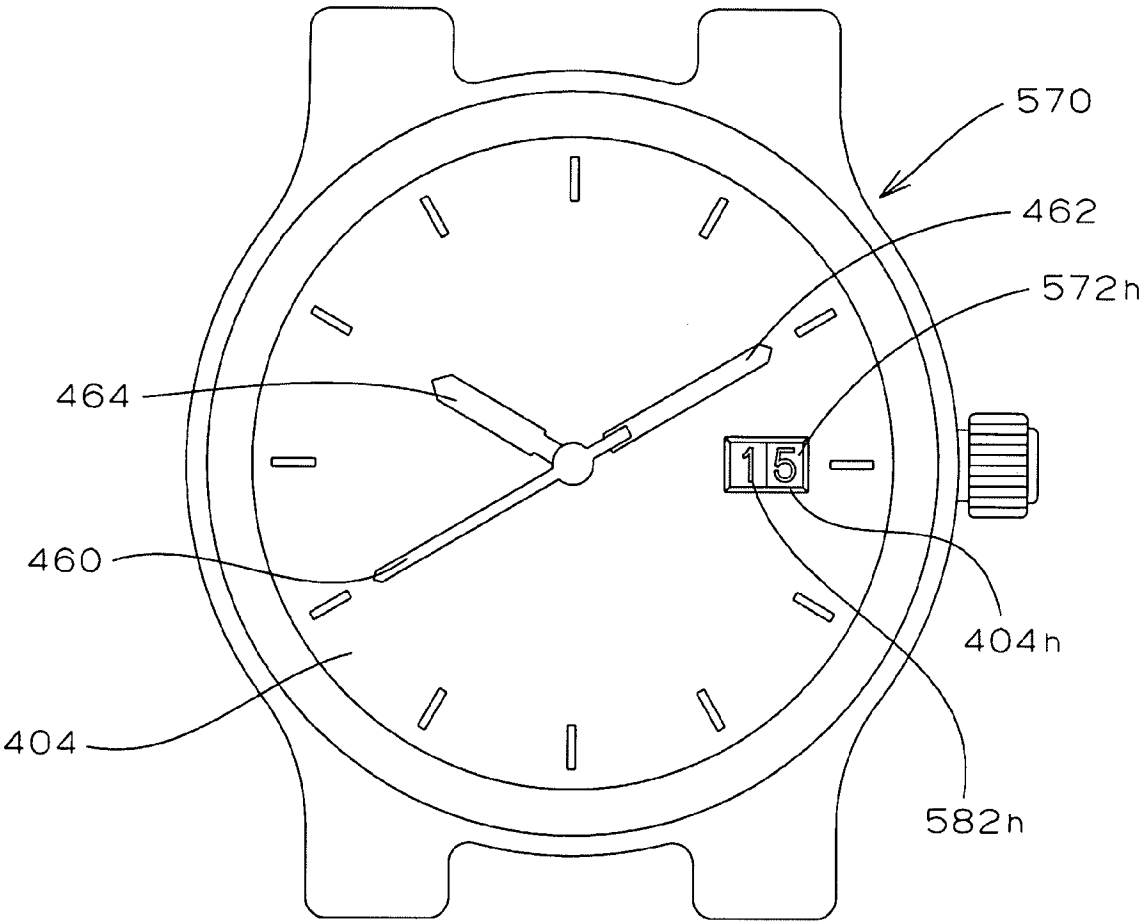
FIG. 15 is a plan view of a construction in which a date window is arranged in the 3 o'clock direction of the dial in a timepiece with a calendar mechanism according to an embodiment of the present invention, showing a state in which a complete indicates "$15^{th}$ day"

Referring to FIG. 15, in a complete 570 of the timepiece with a calendar mechanism of the present invention, the date window 404*h* is formed at the 3 o'clock position of the dial 404. In the complete 570, in the left-hand side portion of the date window 404*h* of the dial 404, the number "1" of the second date letters 582*h* of the second date indicator 582 is arranged, and, in the right-hand side portion of the date window 404*h*, the number "5" of the first date letters 572*h* of the first date indicator 572 is arranged. Thus, the complete 570 indicates "15", that is, "15$^{th}$" day.

Figure 16:
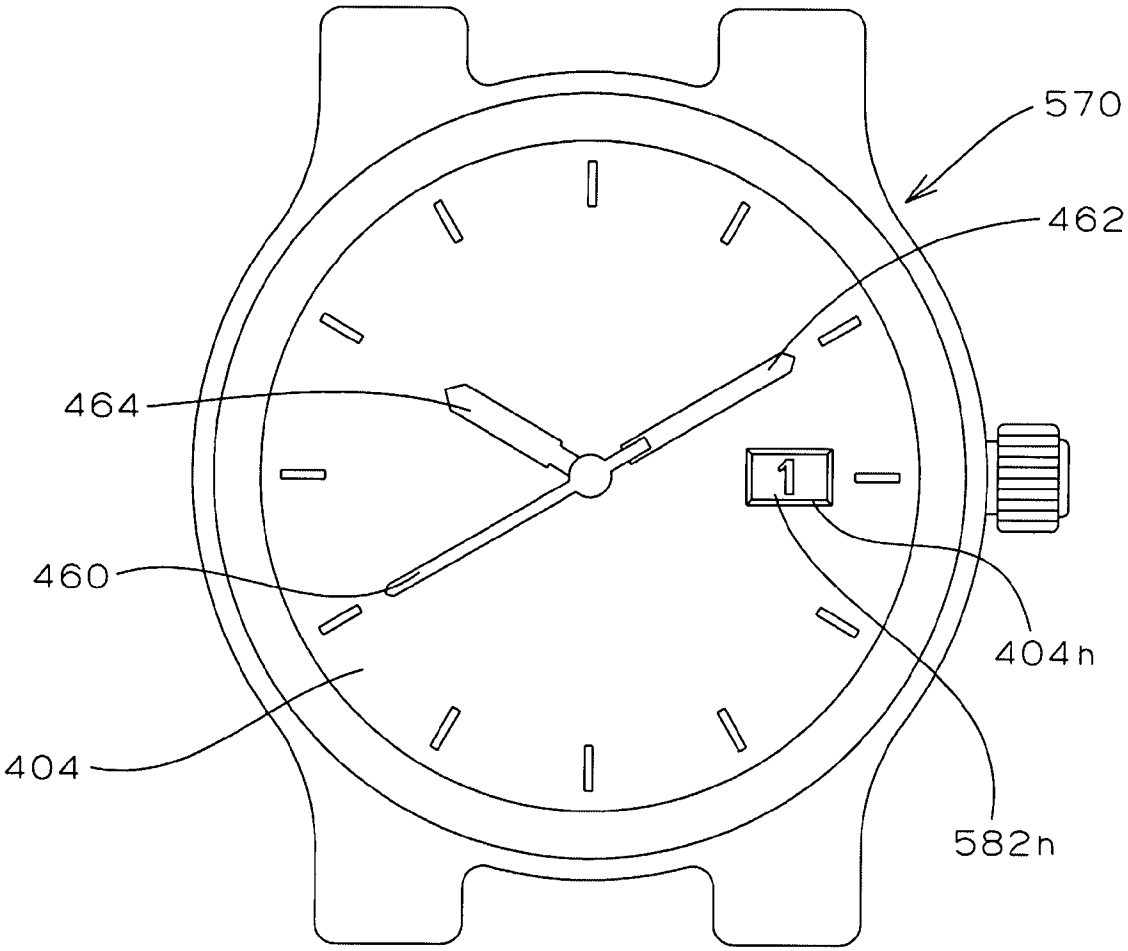
FIG. 16 is a plan view of a construction in which a date window is arranged in the 3 o'clock direction of the dial in a timepiece with a calendar mechanism according to an embodiment of the present invention, showing a state in which a complete indicates "$1^{st}$ day"

Referring to FIG. 16, in the complete 500 of the timepiece with a calendar mechanism of the present invention, the date window 404*h* is formed at the 3 o'clock position of the dial 404. In the complete 500, in the date window 404*h* portion of the dial 404, there is arranged, of the second date letters 582*h* of the second date indicator 582, the number "1" for singly indicating a one-digit date. Thus, the complete 570 indicates "1", that is, "1$^{st}$" day. In this state, in the date window 404*h* portion of the dial 404, there is arranged the portion where nothing is displayed of the first date letter display surface 572*f* of the first date indicator 572. In this construction, the area that can be occupied by the second date letter indicating "1" can be (31/24) times, i.e., approximately 1.3 times, as large as that of the conventional calendar mechanism in a movement of the same size.

Figure 17:
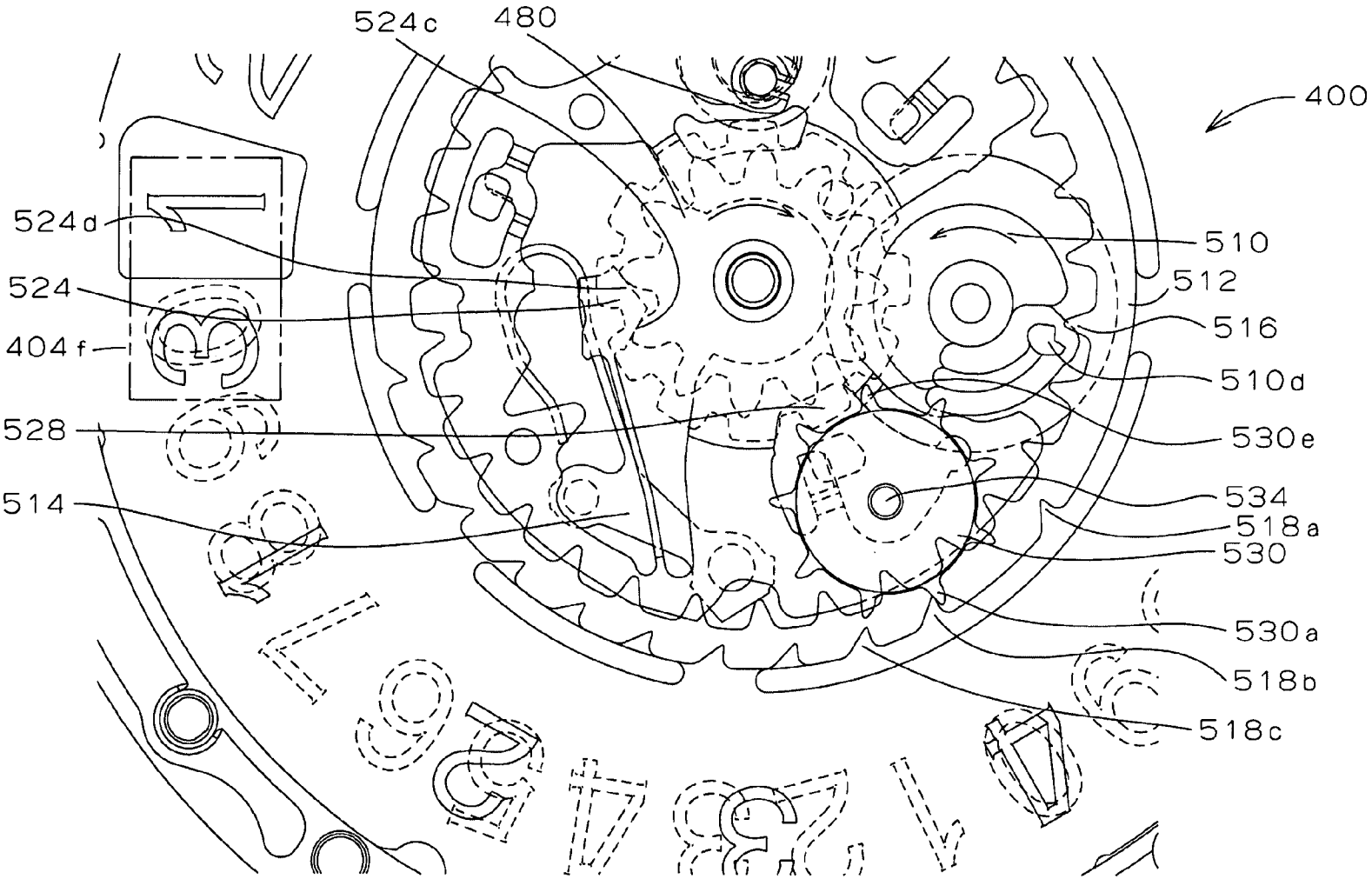
FIG. 17 is a partial plan view, as seen from the dial side, of the structure of the back side of a movement in a timepiece with a calendar mechanism according to an embodiment of the present invention, showing it in a state before the rotation of a first date indicator.

(1.6.2) State in Which the First Date Indicator is About to be Rotated in the Normal Direction FIG. 17 is a partial plan view showing the structure of the back side of the movement 400 as seen from the dial side in the state prior to rotation of the first indicator 512 (i.e., the state prior to date feeding) in the timepiece with a calendar mechanism of the present invention. Referring to FIG. 17, setting portions 524*c* and 524*d* of the second date jumper 524 set positioning tooth portions 526 of the second date indicator 522. The date indicator driving wheel 510 includes one date finger 510*d*. The date indicator driving wheel 510 can rotate in the direction indicated by the arrow (counterclockwise). The intermediate date wheel 530 includes 9 intermediate date teeth 530*a* formed as outer teeth. The date letter displayed by the second date indicator 522 through the date window 404*f* is "3", and the date letter that can be seen through the window portion of the second date indicator 522 is "1". That is, the current date, "31$^{st}$" day, is displayed by the second date indicator 522 and the first date indicator 512 through the date window 404*f*.

Figure 18:
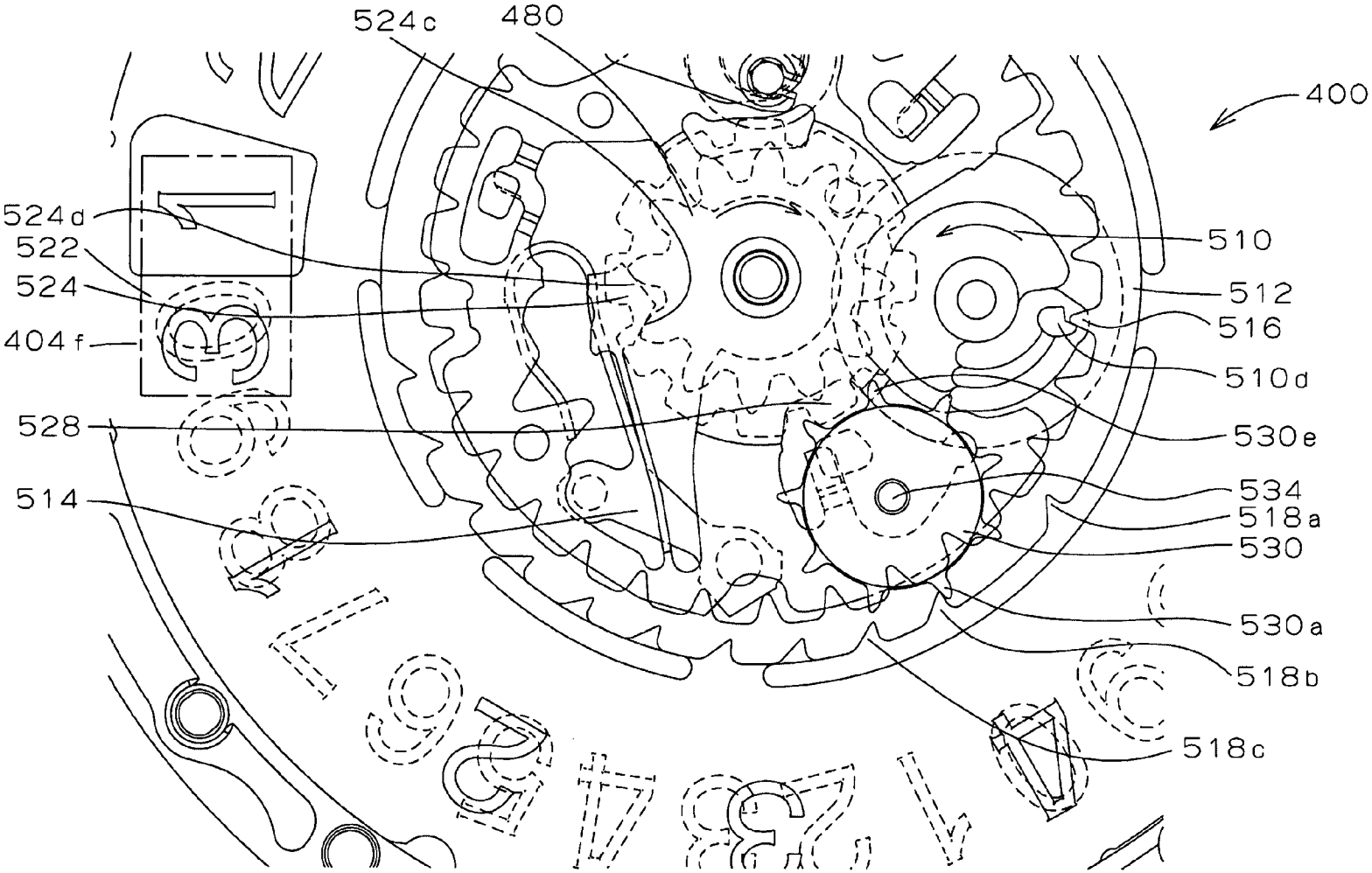
FIG. 18 is a partial plan view, as seen from the dial side, of the structure of the back side of a movement in a timepiece with a calendar mechanism according to an embodiment of the present invention, showing it in a state in which a first date indicator is starting to rotate in normal direction.

(1.6.3) State in Which the First Date Indicator is About to be Rotated in the Normal Direction FIG. 18 is a partial plan view showing the structure of the back side of the movement 400 as seen from the dial side in the state in which the first indicator 512 is about to be rotated in the normal direction (counterclockwise) (i.e., the state in which date feeding has started) in the timepiece with a calendar mechanism of the present invention. Referring to FIG.

18, the setting portions 524*c* and 524*d* of the second date jumper 524 set the positioning tooth portions 526 of the second date indicator 522. Through rotation of the date indicator driving wheel 510 in the direction indicated by the arrow (counterclockwise), the date finger 510*d* starts to feed the first date indicator tooth portions 516, and rotates the first date indicator 512 counterclockwise. The first date indicator 512 rotates counterclockwise, and a second calendar feeding teeth 518*c* rotate the intermediate date teeth 530*a*.

Figure 19:
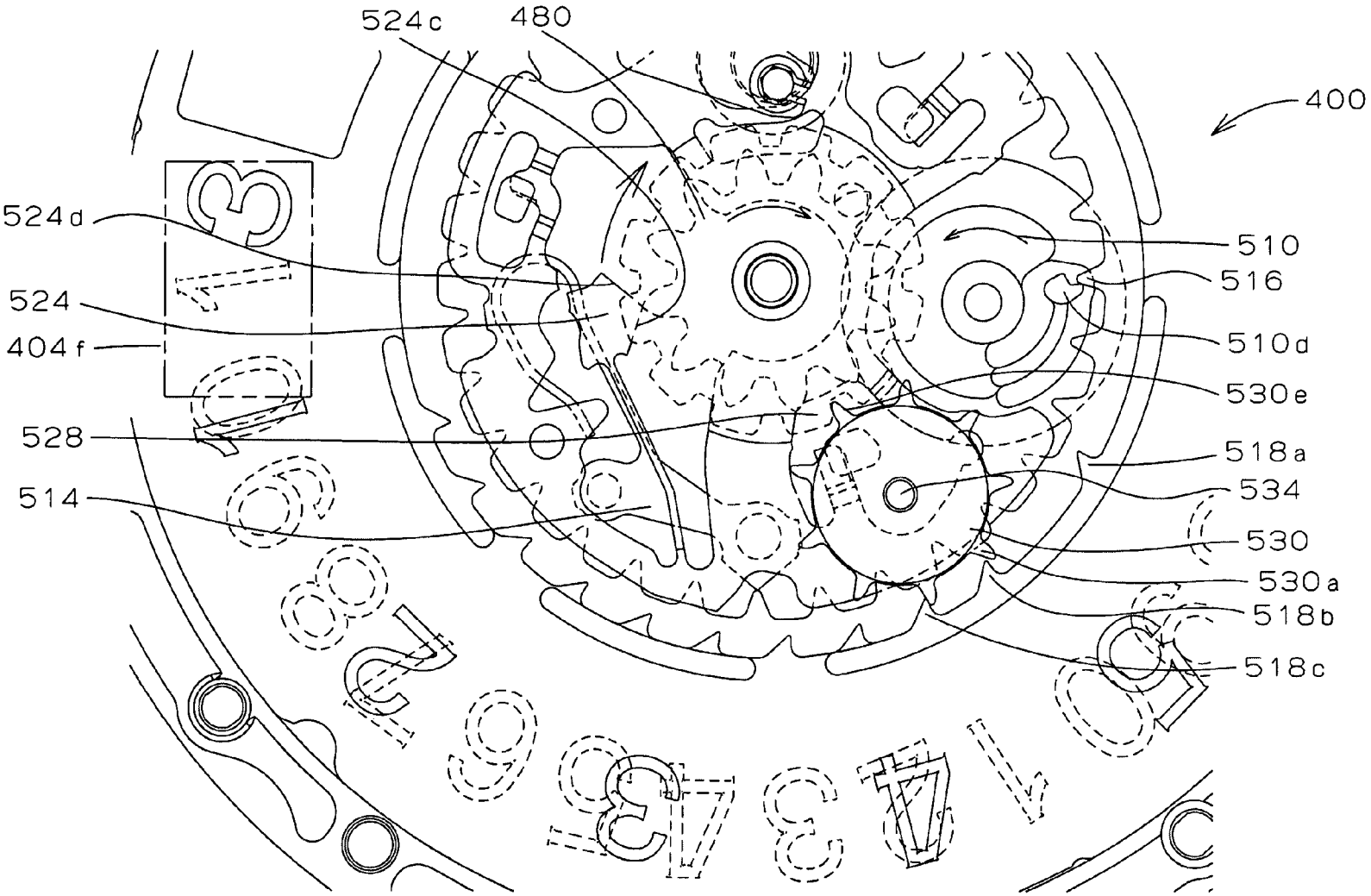
FIG. 19 is a partial plan view, as seen from the dial side, of the structure of the back side of a movement in a timepiece with a calendar mechanism according to an embodiment of the present invention, showing it in a state in which a first date indicator is rotating in normal direction.

(1.6.4) State in Which the First Date Indicator is Being Rotated in the Normal Direction FIG. 19 is a partial plan view showing the structure of the back side of the movement 400 as seen from the dial side in the state in which the first date indicator 512 is being rotated in the normal direction (counterclockwise); the first date indicator 512 rotates in the normal direction, and the forward end portions of the tooth portions 516 of the first date indicator 512 and the crossing forward end portions of the setting portions 514*c* and 514*d* of the first date jumper 514 are in contact with each other. Referring to FIG. 19, the date indicator driving wheel 510 rotates in the direction indicated by the arrow, whereby the date finger 510*d* continues to feed the first date indicator tooth portions 516, and an intermediate date teeth 530*e* rotate the feeding teeth 528 of the second date indicator 522 to rotate the second date indicator 522 clockwise. Then, the date letter indicated through the date window 404*f* by the second date indicator 522 rotates from the state indicating "31" and strives to be placed in the state in which the number "1" singly indicated by the second date indicator 522 is arranged in the date window 404*f*.

During the feeding of the first date indicator 512, the forward end portions of the tooth portions 516 of the first date indicator 512 and the crossing forward end portions of the setting portions 514*c* and 514*d* of the first date jumper 514 are brought into contact with each other. Further, through the rotation of the first date indicator 512 in the direction indicated by the arrow, the second calendar feeding teeth 518*c* rotate the intermediate date teeth 530*a*, and the intermediate date teeth 530*e* rotate the feeding teeth 528, rotating the second date indicator 522 clockwise as indicated by the arrow. During this feeding of the second date indicator 522, the forward end portions of the positioning tooth portions 526 of the second date indicator 522 and the crossing forward end portions of the setting portions 524*c* and 524*d* of the second date jumper 524 are brought into contact with each other.

Figure 20:
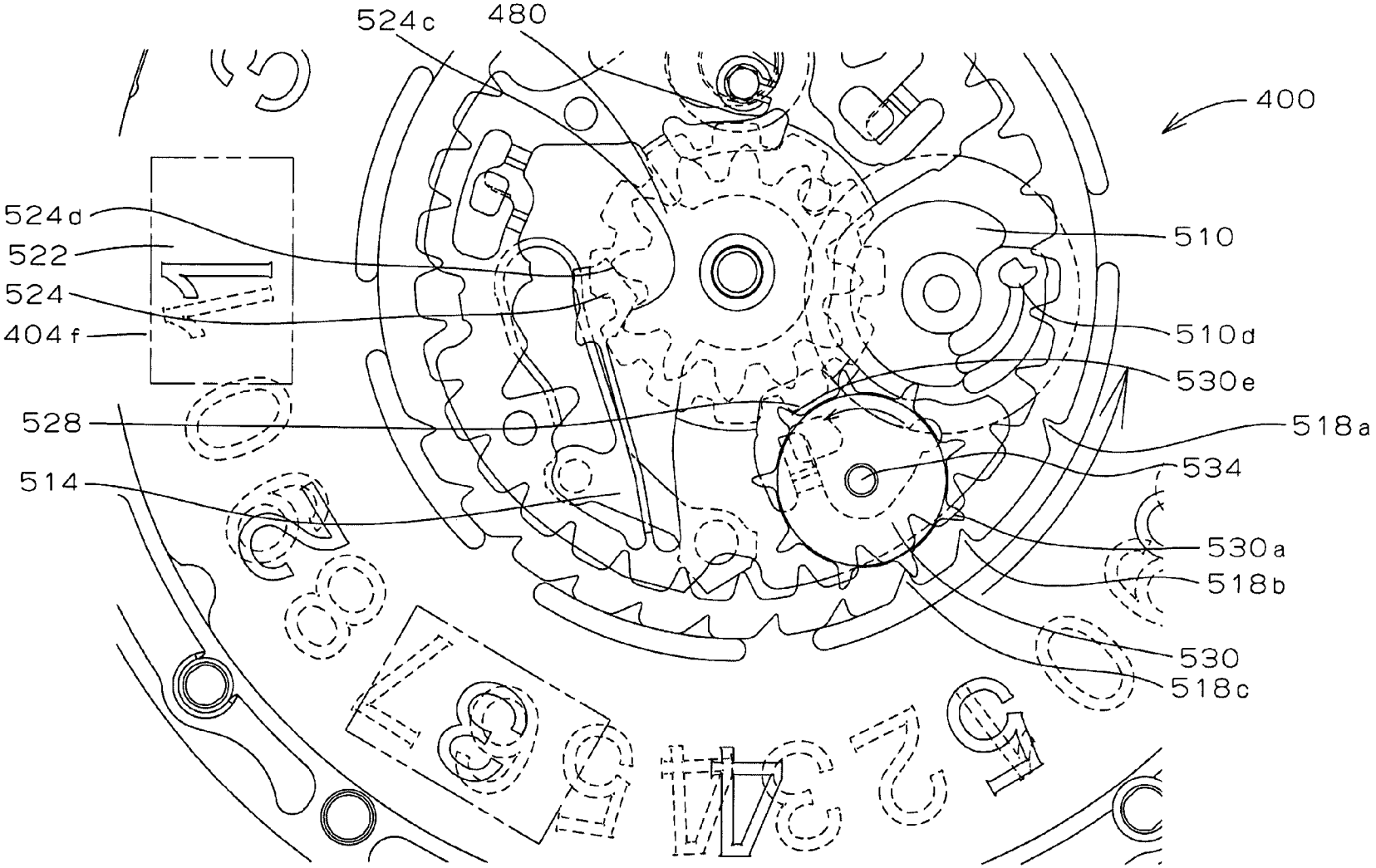
FIG. 20 is a partial plan view, as seen from the dial side, of the structure of the back side of a movement in a timepiece with a calendar mechanism according to an embodiment of the present invention, showing it in a state in which a first date indicator has rotated one pitch in normal direction.

(1.6.5) State in Which the First Date Indicator has Rotated One Pitch in the Normal Direction FIG. 20 is a partial plan view showing the structure of the back side of the movement 400 as seen from the dial side the timepiece with a calendar mechanism of the present invention in a state in which the first date indicator 512 has rotated one pitch (one tooth of the first date indicator, i.e., (360/31) degrees) in the normal direction (counterclockwise). Referring to FIG. 20, when the date indicator driving wheel 510 further rotates in the direction indicated by the arrow from the state shown in FIG. 19, and the date finger 510*d* rotates the first date indicator 512 in the direction indicated by the arrow, positioning is effected, due to the elastic force of the first date jumper 514, on the first date indicator 512 at the position attained through rotation by (360/31) degrees from the state shown in FIG. 18. Further, due to the elastic force of the second date jumper 524, positioning is effected on the second date indicator 522 at the position attained through clockwise rotation by 30 degrees from the state shown in FIG. 18. As a result, the indication of the second date indicator 522 is placed, through rotation from the state in which "31" is displayed, in a state in which the number "1" singly displayed by the second date indicator 522 is arranged in the date window 404*f*. That is, in the state shown in FIG. 20, "1$^{st}$ day" is displayed in the date window 404*f* of the dial of the timepiece with a calendar mechanism.

(1.6.6) Construction of Calendar Corrector Mechanism

Referring to FIGS. 1, 17 and 22, in the movement 400, a calendar corrector mechanism includes a first calendar corrector wheel 590, a second calendar corrector wheel 591, and a date corrector lever 593. The second calendar corrector wheel 591 can rotate around a second calendar corrector wheel pin provided on the main plate 402. A date corrector lever pin 593*b* is fixed to the second calendar corrector wheel 591. The rotation center axis of the date corrector lever pin 593*b* is situated at a position offset from the rotation center axis of the second calendar corrector wheel 591. The date corrector lever 593 is rotatable with respect to a shaft portion of the date corrector lever pin 593*b*.

Through the rotation of the second calendar corrector wheel 591, the date corrector lever 593 makes an eccentric movement to enable a correction forward end portion of the date corrector lever 593 to come into contact with the first date indicator tooth portions 516. Through the movement of the correction forward end portion of the date corrector lever 593, it is possible to rotate the first date indicator 552 one pitch at one time. In the state in which the winding stem 410 is at the 1$^{st}$ step, an interlock hole of the first calendar corrector wheel 590 is fit-engaged with the second corner portion 410*f* of the winding stem 410, and the first calendar corrector wheel 590 rotates based on the rotation of the winding stem 410.

When, in this state, the winding stem 410 is rotated in a first direction, for example, to the left, the second calendar corrector wheel 591 rotates based on the rotation of the first calendar corrector wheel 590. Based on the rotation of the second calendar corrector wheel 591, the date corrector lever 593 moves to enable the correction forward end portion of the date corrector lever 593 to rotate counterclockwise one pitch at one time. When, in the state in which the winding stem 410 is drawn out to the 1$^{st}$ step, the winding stem 410 is rotated in the first direction (to the left), the correction forward end portion of the date corrector lever 593 causes the first date indicator 512 to rotate counterclockwise one pitch at one time; through the counterclockwise rotation of the first date indicator 512, the second calendar feeding teeth 518*b* rotate the intermediate date teeth 530*a*, and the intermediate date teeth 530*e* rotate the feeding teeth 528, making it possible to rotate the second date indicator 522 clockwise.

In the date corrector mechanism of the present invention, when the winding stem 410 is at the 1$^{st}$ step, it is possible to perform "date correction" by rotating the winding stem 410 in the first direction (to the left); even if the winding stem 410 is rotated in a direction opposite to the first direction (to the right), "date correction" cannot be effected.

(1.7) Operation of the Timepiece with a Calendar Mechanism of the Present Invention (1.7.1) Ordinary Hand Movement Operation Next, the ordinary hand movement operation of the timepiece with a calendar mechanism of the present invention will be described. Referring to FIGS. 1 through 3 and 21, the battery 440 constitutes the power source of the timepiece. A crystal oscillator accommodated in the crystal oscillator unit 650 oscillates, for example, at 32,768 Hz. Based on the oscillation of this crystal oscillator, the oscillation unit 602 contained in the integrated circuit 654 outputs a reference signal, and the frequency division control unit 604 effects frequency division on the output signal of the oscillation unit 602. Based on the output signal of the frequency division unit 604, the motor drive unit 606 outputs a motor drive signal for driving a step motor to the coil block 630. When the coil block 630 inputs the motor drive signal, the stator 632 is magnetized to rotate the rotor 634. The rotor 634 rotates, for example, 180 degrees every second. Based on the rotation of the rotor 634, the second wheel & pinion 442 rotates via the rotation of the fifth wheel & pinion 441. The second wheel & pinion 442 makes one rotation per minute. Of time information, "second" is indicated by the second hand 460 mounted to the second wheel & pinion 442.

The third wheel & pinion 444 rotates based on the rotation of the second wheel & pinion 442. The center wheel & pinion 446 rotates based on the rotation of the third wheel & pinion 444. Instead of the center wheel & pinion 446, it is also possible to use a minute wheel. The center wheel & pinion 446 makes one rotation per hour. Of the time information, "minute" is indicated by the minute hand 462 mounted to the center wheel & pinion 446. A slip mechanism is provided on the center wheel & pinion 446. Due to the slip mechanism, when performing hand matching, in a state in which the second hand 460 is kept at rest with the cogwheel portion of the fifth wheel & pinion 442 set by the train wheel setting lever 468, the winding stem 410 is rotated, whereby it is possible to rotate the minute hand 462 and the hour hand 464. The minute wheel 448 rotates based on the rotation of the center wheel & pinion 446. The hour wheel 480 rotates based on the rotation of the minute wheel 448. The hour wheel 480 makes one rotation every 12 hours. Of the time information, "hour" is indicated by an hour hand 464 mounted to the hour wheel 480.

(1.7.2) Calendar Feeding Operation

Next, the calendar feeding operation of the timepiece with a calendar mechanism of the present invention will be described. Referring to FIGS. 1 through 4, 17 and 21, the date indicator driving wheel 510 rotates based on the rotation of the hour wheel 480. Through the rotation of the date indicator driving wheel 510, the date finger 510*d* of the date indicator driving wheel 510 rotates the first date indicator 512. Referring to FIG. 17, the date indicator driving wheel 510 rotates in the direction indicated by the arrow (counterclockwise), whereby the date finger 510*d* feeds the first date indicator tooth portions 516, and rotates the first date indicator 512 clockwise once a day.

When the date indication by the first date indicator 512 and the second date indicator 522 is changed from "9$^{th}$ day," to "10$^{th}$ day" the date letter "9" displayed through the date window 404*f* solely by the second date indicator 522 is changed to the date letter "1" indicated through the date window 404*f* by the second date indicator 522 and the date letter "0" indicated through the date window 404*f* by the first date indicator 512. Through the counterclockwise rotation of the first date indicator 512, the eleventh calendar feeding tooth 518*k* pushes the tooth portions 530*a* of the intermediate date wheel 530, whereby the intermediate date wheel 530 is rotated; further, the intermediate date teeth 530*e* rotate the feeding teeth 528 to rotate the second date indicator 522 clockwise, and the date letter indicated through the date window 404*f* by the second date indicator 522 is rotated from the state in which it singly indicates "9" to be changed to a state in which it indicates "1" of the ten place.

When the date indication by the first date indicator 512 and the second date indicator 522 is changed from "19$^{th}$ day" to "20$^{th}$ day" the date letter displayed through the date window 404*f* by the first date indicator 512 is changed from "9" to "0". Through the counterclockwise rotation of the first date indicator 512, the twelfth calendar feeding tooth 518*m* pushes the tooth portions 530*a* of the intermediate date wheel 530 to thereby rotate the intermediate date wheel 530; further, the intermediate date teeth 530*e* rotate the feeding teeth 528 to rotate the second date indicator 522 clockwise, and the date letter displayed through the date window 404*f* by the second date indicator 522 is changed to "2" through rotation from the state in which "1" is displayed.

When the date display is changed from "29$^{th}$ day" to "30$^{th}$ day" the first date indicator 512 rotates counterclockwise, whereby the first calendar feeding tooth 518*a* pushes the tooth portions 530*a* of the intermediate date wheel 530 to thereby rotate the intermediate date wheel 530; further, the intermediate date teeth 530*e* rotate the feeding teeth 528 to rotate the second date indicator 522 clockwise. As a result, the date letter displayed through the date window 404*f* by the second date indicator 522 is changed to "3" through rotation from the state in which "2" is displayed, and the date letter displayed through the date window 404*f* by the first date indicator 512 is changed to "0" through rotation from the state in which "9" is displayed.

When the date display is changed from "30$^{th}$ day" to "31$^{st}$ day" the first date indicator 512 rotates counterclockwise, but the calendar feeding teeth do not push the tooth portions 530*a* of the intermediate date wheel 530. Thus, the second date indicator 522 does not rotate. As a result, the date letter displayed through the date window 404*f* by the first date indicator 512 is changed to "1" through rotation from the state in which "0" is displayed, whereas the date letter displayed through the date window 404*f* by the second date indicator 522 remains in the state in which "3" is displayed.

When the date indication by the first date indicator 512 and the second date indicator 522 is changed from "31$^{st}$ day" to "1$^{st}$ day" the first date indicator 512 rotates counterclockwise, whereby the second calendar feeding tooth 518*b* pushes the tooth portions 530*a* of the intermediate date wheel 530 to thereby rotate the intermediate date wheel 530; further, the intermediate date teeth 530*e* rotate the feeding teeth 528 to rotate the second date indicator 522 clockwise, and the date letter displayed through the date window 404*f* by the second date indicator 522 is changed to a state in which "1" is singly displayed through rotation from the state in which "3" of the ten place is displayed.

Similarly, when "1$^{st}$ day" is changed to "2$^{nd}$ day", when "2$^{nd}$ day" is changed to "3$^{rd}$ day", when "3$^{rd}$ day" is changed to "4$^{th}$ day", when "4$^{th}$ day" is changed to "5$^{th}$ day", when "5$^{th}$ day" is changed "6$^{th}$ day", when "6$^{th}$ day" is changed to "7$^{th}$ day", when "7$^{th}$ day" is changed to "8$^{th}$ day", when "8$^{th}$ day" is changed to "9$^{th}$ day" and when "9$^{th}$ day" is changed to "10$^{th}$ day", the first date indicator 512 rotates, whereby the second date indicator 522 rotates. That is, at this time, the date indicator driving wheel 510 rotates, whereby the date finger 510*d* of the date indicator driving wheel 510 rotates the first date indicator 512 one pitch a day.

In contrast, except when "1$^{st}$ day" is changed to "2$^{nd}$ day", when "2$^{nd}$ day" is changed to "3$^{rd}$ day", when "3$^{rd}$ day" is changed to "4$^{th}$ day", when "4$^{th}$ day" is changed to "5$^{th}$ day", when "5$^{th}$ day" is changed "6$^{th}$ day", when "6$^{th}$ day" is changed to "7$^{th}$ day", when "7$^{th}$ day" is changed to "8$^{th}$ day", when "8$^{th}$ day" is changed to "9$^{th}$ day", when "9$^{th}$ day" is changed to "10$^{th}$ day", when "19$^{th}$ day" is changed to "20$^{th}$ day", when "29$^{th}$ day" is changed to "30$^{th}$ day" and when "31$^{st}$ day" is changed to "1$^{st}$ day", even if the first date indicator 512 rotates, the second date indicator 522 does not rotate.

Referring to FIG. 20, when the date indicator driving wheel 510 further rotates in the direction indicated by the arrow from the state shown in FIG. 19, and the date finger 510*d* rotates the first date indicator 512 in the direction indicated by the arrow, positioning is effected on the first date indicator

512, due to the elastic force of the first date jumper 514 at the position attained through counterclockwise rotation by (360/31) degrees from the state shown in FIG. 18. Further, due to the elastic force of the second date jumper 524, positioning is effected on the second date indicator 522 at the position attained through clockwise rotation by 30 degrees from the state shown in FIG. 18. As a result, the indication of the second date indicator 522 is changed through rotation to a state in which "1" is singly indicated from the state in which "3" is displayed at the ten place. That is, in the state shown in FIG. 20, the second date indicator 522 singly indicates "1" in the date window 404*f* of the dial of the timepiece with a calendar mechanism, thus indicating "1$^{st}$ day".

(1.7.3) Hand Matching Operation

Next, the operation when hand matching is effected in the timepiece with a calendar mechanism of the present invention will be described. Referring to FIGS. 1 through 3 and 22, in the movement 400, when the winding stem 410 is at the 2$^{nd}$ step, the interlock ratchet of the clutch wheel 472 is fit-engaged with the first corner portion 410*b* of the winding stem 410, and the clutch wheel 472 can rotate based on the rotation of the winding stem 410. That is, when the winding stem 410 is rotated in the state in which the winding stem 410 has been drawn out to the 2$^{nd}$ step, the setting wheel 449 rotates based on the rotation of the clutch wheel 472. Based on the rotation of the setting wheel 449, the minute wheel 448 rotates.

Thus, when the winding stem 410 is at the 2$^{nd}$ step, by rotating the winding stem 410, it is possible to perform "hand matching". That is, when the winding stem 410 is at the 2$^{nd}$ step, by rotating the winding stem 410, the hour wheel 480 is rotated to correct the "hour" display indicated by the hour hand 464 mounted to the hour wheel 480; at the same time, by rotating the center wheel & pinion 446, it is possible to correct the "minute" display indicated by the minute hand 462 mounted to the center wheel & pinion 446. When the winding stem 410 is at the 2$^{nd}$ step, the train wheel setting lever 468 sets the fifth wheel & pinion 441, and, while, through this operation, the "hour" and "minute" displays are being corrected, the fifth wheel & pinion 441 and the second wheel & pinion 442 do not rotate, and the "second" display does not change.

(1.7.4) Date Correction Operation

Next, the operation when performing date correction in the timepiece with a calendar mechanism of the present invention will be described. Referring to FIGS. 1 and 22, in the movement 400, when the winding stem 410 is at the 1$^{st}$ step, the interlock crown of the first calendar corrector wheel 590 is fit-engaged with the second corner portion 410*f* of the winding stem 410, and the first calendar corrector wheel 590 can rotate based on the rotation of the winding stem 410. That is, in the state in which the winding stem 410 is arranged at the 1$^{st}$ step, when the winding stem 410 is rotated in the first direction (to the left), the second calendar corrector wheel 591 rotates based on the rotation of the first calendar corrector wheel 590.

The date corrector lever 593 makes an eccentric movement through the rotation of the second calendar corrector wheel 591, and the correction forward end portion of the date corrector lever 593 can come into contact with the first date indicator tooth portions 516. When the winding stem 410 is rotated in the first direction (to the left), it is possible to rotate the first date indicator 512 one pitch at one time through the movement of the correction forward end portion of the date corrector lever 593. In the state in which the winding stem 410 is at the 1$^{st}$ step, the interlock hole of the first calendar corrector wheel 590 is fit-engaged with the second corner portion 410*f* of the winding stem 410, and the first calendar corrector wheel 590 rotates based on the rotation of the winding stem 410.

In this state, when the winding stem 410 is rotated in the first direction (to the left), the second calendar corrector wheel 591 rotates based on the rotation of the first calendar corrector wheel 590. The date corrector lever 593 moves based on the rotation of the second calendar corrector wheel 591, and the correction forward end portion of the date corrector lever 593 can rotate the first date indicator 512 counterclockwise one pitch at one time. That is, in the state in which the winding stem 410 has been drawn out to the 1$^{st}$ step, when the winding stem 410 is rotated in the first direction (to the left), the second calendar corrector wheel 591 rotates, and the correction forward end of the date corrector lever 593 rotates the first date indicator 512 counterclockwise, whereby the second calendar feeding teeth 518*b* rotates the intermediate date teeth 530*a*, and the intermediate date teeth 530*e* rotate the feeding teeth 528, making it possible to rotate the second date indicator 522 clockwise.

When the date indication is changed from "29" to "30" through rotation, in the state in which the winding stem 410 has been drawn out to the 1$^{st}$ step, when the winding stem 410 is rotated in the first direction (to the left), the second calendar corrector wheel 591 rotates, and the correction forward end portion of the date corrector lever 593 rotates the first date indicator 512 counterclockwise one pitch at one time, with the first date indicator 512 rotating counterclockwise, whereby the first calendar feeding tooth 518*a* pushes the tooth portions 530*a* of the intermediate date lever 530 to thereby rotate the intermediate date wheel 530, and the intermediate date teeth 530*e* rotate the feeding teeth 528, causing the second date indicator 522 to rotate clockwise.

When the date indication is changed from "9" to "10" through rotation, in the state in which the winding stem 410 has been drawn out to the 1$^{st}$ step, when the winding stem 410 is rotated in the first direction (to the left), the second calendar corrector wheel 591 rotates, and the correction forward end portion of the date corrector lever 593 rotates the first date indicator 512 counterclockwise one pitch atone time, with the first date indicator 512 rotating counterclockwise, whereby the eleventh calendar feeding tooth 518*k* pushes the intermediate tooth portions 530*a* of the intermediate date wheel 530 to thereby rotate the intermediate date wheel 530, and the intermediate date teeth 530*e* rotate the feeding teeth 528, causing the second date indicator 522 to rotate clockwise.

When the date indication is changed from "19" to "20" through rotation, in the state in which the winding stem 410 has been drawn out to the 1$^{st}$ step, when the winding stem 410 is rotated in the first direction (to the left), the second calendar corrector wheel 591 rotates, and the correction forward end portion of the date corrector lever 593 rotates the first date indicator 512 counterclockwise one pitch at one time, with the first date indicator 512 rotating counterclockwise, whereby the twelfth calendar feeding tooth 518*m* pushes the intermediate tooth portions 530*a* of the intermediate date wheel 530 to thereby rotate the intermediate date wheel 530, and the intermediate date teeth 530*e* rotate the feeding teeth 528, causing the second date indicator 522 to rotate clockwise.

When the date letter indicated through the date window 404*f* by the second date indicator 522 is changed to "1" through rotation from the state in which "31" is indicated, in the state in which the winding stem 410 has been drawn out to the 1$^{st}$ step, when the winding stem 410 is rotated in the first direction (to the left), the second calendar corrector wheel 591 rotates, and the correction forward end portion of the date corrector lever 593 rotates the first date indicator 512 counterclockwise one pitch at one time, with the first date indicator 512 rotating clockwise, whereby the first calendar feeding tooth 518*a* rotates the intermediate date tooth portions 530*a*, and the intermediate date teeth 530*e* rotate the feeding teeth 528, causing the second date indicator 522 to rotate clockwise.

When the date letter indicated through the date window 404*f* by the second date indicator 522 is changed to "2" through rotation from the state in which "1" is indicated, in the state in which the winding stem 410 has been drawn out to the 1st step, when the winding stem 410 is rotated in the first direction (to the left), the second calendar corrector wheel 591 rotates, the calendar corrector wheel 592 rotates, and the correction forward end portion of the date corrector lever 593 rotates the first date indicator 512 counterclockwise one pitch at one time, with the first date indicator 512 rotating clockwise, whereby the second calendar feeding tooth 518*b* pushes the intermediate date tooth portions 530*a*, and the intermediate date teeth 530*e* rotate the feeding teeth 528, causing the second date indicator 522 to rotate clockwise.

Thus, when the winding stem 410 is at the 1st step, by rotating the winding stem 410 in the first direction (to the left), it is possible to effect "date correction". When the winding stem 410 is at the 1st step, even if the winding stem 410 is rotated in a direction opposite to the first direction (i.e., to the right), it is impossible to effect "date correction".

(2) Other Embodiments of the Calendar Mechanism of the Present Invention (2.1) Embodiment of the Mechanical Timepiece Although in the above-described embodiment of the present invention the timepiece with a calendar mechanism consists of an analog electronic timepiece, the present invention is applicable not only to an analog electronic timepiece but also to a mechanical timepiece. That is, the concept of "timepiece with a calendar mechanism" of this specification also covers a "mechanical timepiece" and also an "analog electronic timepiece" and analog timepieces of all other operating principles.

In an embodiment of a mechanical timepiece, the rotation of a movement barrel rotated by the power of a mainspring is controlled by a governor and an escapement. Through rotation of the movement barrel, a second wheel & pinion makes one rotation per minute via rotation of a center wheel & pinion and a third wheel & pinion. Further, through the rotation of the movement barrel, a minute indicator makes one rotation per hour. Through the rotation of the minute indicator, an hour wheel makes one rotation every 12 hours via through rotation of a minute wheel. Through the rotation of the hour wheel, a date indicator driving wheel rotates, and, through rotation of a date finger, which rotates through the rotation of the date indicator driving wheel, a first date indicator can rotate. In the embodiment of the mechanical timepiece, the structure and operation of the calendar mechanism are the same as the structure and operation of the above-described embodiment, in which the timepiece with a calendar mechanism consists of an analog electronic timepiece.

(2.2) Other Embodiments of Second Date Indicator

In the above-described embodiment of the present invention, the structure was described, the second date indicator has a second date letter display surface, and, on the second date letter display surface, there are provided at equal angular intervals the numbers of "1", "2", "3", "4", "5", "6", "7", "8" and "9" for singly displaying a one-digit date, and the numbers of "1", "2" and "3" for displaying the ten place of a date; a window portion is provided between the number "1" for displaying the ten place and the number "2" for displaying the ten place; a window portion is provided between the number "2" for displaying the ten place and the number "3" for displaying the ten place; and a window portion is provided between the number "1" for displaying the ten place and the number "9" for singly displaying a one-digit date.

Further, according to another embodiment of the present invention, it is possible to realize a structure in which, on the second date letter display surface of the second date indicator, there are provided the numbers of "1", "2", "3", "4", "5", "6", "7", "8" and "9" for singly displaying a one-digit date, the number "30" for singly displaying the date of "30", the number "31" for singly displaying the date of "31", the number "1" for displaying the ten place of a date and the number "2" for displaying the ten place of a date; a window portion is provided between the number "1" for displaying the ten place and the number "2" for displaying the ten place, and a window portion is provided between the number "2" for indicating the ten place and the number "30" for singly indicating the date of "30".

In the structure of another embodiment, it is possible to adopt a construction in which the second date indicator 522 includes 13 positioning tooth portions formed as outer teeth, and 13 feeding teeth formed as outer teeth. The positioning tooth portions maybe arranged at equal angular intervals, e.g., at an interval of (360/13) degrees. The feeding teeth may be arranged at equal angular intervals, e.g., at an interval of (360/13) degrees. In this other embodiment, the structure and operation of the other portions of the calendar mechanism are the same as those of the above-described embodiment in which the timepiece with a calendar mechanism consists of an analog electronic timepiece.

In the present invention, the first date indicator can indicate the one place of a date, and the second date indicator can indicate the ten place of a date and can singly indicate a one-digit date. According to the present invention, it is possible to simplify the construction of the movement, and to produce a timepiece with a calendar mechanism whose date indication is large and easy to see.

What is claimed is:

1. A timepiece equipped with a calendar mechanism including two date indicators, the timepiece comprising:

a first date indicator configured to indicate a units place of a date;

a first date jumper for setting a position of the first date indicator in a rotation direction;

a second date indicator configured to indicate a tens place of the date and to singly indicate a one-digit date; and a second date jumper for setting a position of the second date indicator in a rotation direction;

wherein the first date indicator has a first date character display surface provided with a set of numbers including "0", "1", "2", "3", "4", "5", "6", "7", "8" and "9" for indicating the units place of the date;

wherein the first date indicator has 31 first date indicator tooth portions formed as inner teeth at an angular interval of (360/31) degrees and 12 calendar feeding teeth formed as inner teeth, the 12 calendar feeding teeth comprising first to tenth calendar feeding teeth arranged in a first direction at an angular interval of (360/31) degrees, an eleventh calendar feeding tooth arranged at an angular interval of (360*10/31) degrees in a second direction opposite to the first direction relative to the first calendar feeding tooth, and a twelfth calendar feeding tooth arranged at an angular interval of (360*10/31) degrees in the first direction relative to the eleventh calendar feeding tooth;

wherein the second date indicator has a second date character display surface provided with numbers for singly displaying the one-digit date, and numbers for displaying solely the tens place of the date;

wherein the second date indicator has at least one window portion for displaying the units place of the date using the numbers provided on the first date character display surface of the first date indicator; and wherein the second date character display surface of the first date indicator is arranged at a position closer to a dial than the first date character display surface of the second date indicator.

2. A timepiece with a calendar mechanism according to claim 1; wherein:

the set of numbers provided on the first date character display surface is followed by another set of numbers including numbers "0", "1", "2", "3", "4", "5", "6", "7", "8", "9", "0" and "1" for displaying the units place of the date;

the numbers provided on the second date character display surface include the numbers "1" through "9" for singly displaying the one-digit date and the numbers "1", "2" and "3" for displaying solely the tens place of the date, the numbers for singly displaying the one-digit date and the numbers for displaying solely the tens place of the date being arranged at equal angular intervals; and the at least one window portion comprises a first window portion formed between the number "1" for indicating the tens place and the number "2" for indicating the tens place, a second window portion formed between the number "2" for indicating the tens place and the number "3" for indicating the tens place, and a third window portion formed between the number "1" for indicating the tens place and the number "9" for singly displaying the one-digit date; and the first, second and third window portions are formed at equal angular intervals.

3. A timepiece with a calendar mechanism according to claim 2; wherein the set of numbers and the another set of numbers provided on the first date character display surface are arranged at an angular interval of (360/31) degrees;

the numbers "1" through "9" are arranged on the second character display surface at an angular interval of (360/12) degrees, and a set formed of the numeral "1" and the first window portion, a set formed of the numbers "2" and the second window portion, and a set formed of the number "3" and the third window portion are arranged at an angular interval (360/12) degrees;

the display of $1^{st}$ through $9^{th}$ days is effected solely with the numbers provided on the second date character display surface; and in displaying $10^{th}$ through $31^{st}$ days, the units place is indicated through a corresponding one of the first, second and third window portions of the second date indicator by using the numbers provided on the first date character display surface, and the tens place is indicated by using the numbers provided on the second date character display surface.

4. A timepiece with a calendar mechanism according to claim 1; wherein a center axis of rotation of the first date indicator is coincident with a center axis of rotation of the second date indicator; and further comprising an intermediate date wheel for undergoing rotation in accordance with the rotation of the first date indicator to thereby rotate the second date indicator.

5. A timepiece with a calendar mechanism according to claim 1; wherein the second date character display surface of the second date indicator is further provided with a number for singly displaying a two-digit date.

6. A timepiece with a calendar mechanism according to claim 1; further comprising an intermediate date wheel for undergoing rotation in accordance with the rotation of the first date indicator to thereby rotate the second date indicator.

7. A timepiece with a calendar mechanism according to claim 3; wherein a center axis of rotation of the first date indicator is coincident with a center axis of rotation center of the second date indicator; and further comprising an intermediate date wheel for undergoing rotation based on in accordance with the rotation of the first date indicator to thereby rotate the second date indicator.

8. A timepiece with a calendar mechanism according to claim 3; wherein the second date character display surface of the second date indicator is further provided with a number for singly displaying a two-digit date.

9. A timepiece with a calendar mechanism according to claim 1; wherein the first date jumper has a spring portion and setting portions provided at forward ends of the spring portions for setting the tooth portions of the first date indicator.

10. A timepiece equipped with a calendar mechanism, the timepiece comprising:

a first date indicator for displaying a units place of a date, the first date indicator comprising a display surface provided with a plurality of sequences of numbers spaced apart angularly and comprising a first sequence of numbers which are ordered by increasing value from 0 to 9, a second sequence of numbers following the first sequence and which are ordered by increasing value from 0 to 9, and a third sequence of numbers following the second sequence and which are ordered by increasing value from 0 to 1; 31 first date indicator tooth portions formed as inner teeth arranged circularly and spaced apart angularly; and 12 calendar feeding teeth formed as inner teeth, the calendar feeding teeth comprising first to tenth calendar feeding teeth spaced apart angularly in a first direction, an eleventh calendar feeding tooth arranged at an angular interval in a second direction opposite to the first direction relative to the first calendar feeding tooth, and a twelfth calendar feeding tooth arranged at an angular interval in the first direction relative to the eleventh calendar feeding tooth;

a first date jumper for setting a position of the first date indicator in a rotation direction;

a second date indicator disposed in superimposed and concentric relationship relative to the first date indicator for displaying a tens place of the date and for singly displaying a one-digit date, the second date indicator comprising a display surface provided with a plurality of sequences of numbers spaced apart angularly and comprising a first sequence of numbers which are ordered by increasing value from 1 to 9 for singly displaying the one-digit date, and a second sequence of numbers following the first sequence of numbers and which are ordered by increasing value from 1 to 3 for solely displaying the tens place of the date; and at least one window portion for selectively displaying the units place of the date using a number from the sequence of numbers of first date indicator; and a second date jumper for setting a position of the second date indicator in a rotation direction.

11. A timepiece equipped with a calendar mechanism according to claim 10; wherein the at least one window portion comprises a plurality of window portions each for selectively displaying the units place of the date using a number from the sequence of numbers of the first date indicator, the plurality of window portions comprising a first window portion formed between the numbers 1 and 2 of the second sequence of numbers of the second date indicator, a second window portion formed between the numbers 2 and 3 of the second sequence of numbers of the second date indicator, and a third window portion formed between the number 1 of the second sequence of numbers of the second date indicator and the number 9 of the first sequence of numbers of the second date indicator.

12. A timepiece equipped with a calendar mechanism according to claim 11; wherein the units place of the date using a number from the sequence of numbers of the first date indicator is displayed only via one of the window portions of the second date indicator.

13. A timepiece with a calendar mechanism according to claim 10; wherein a center axis of rotation of the first date indicator is coincident with a center axis of rotation of the second date indicator; and further comprising an intermediate date wheel for undergoing rotation in accordance with the rotation of the first date indicator to thereby rotate the second date indicator.

14. A timepiece with a calendar mechanism according to claim 10; further comprising a dial for displaying date information; and wherein the display surface of the first date indicator is disposed closer to the dial than the display surface of the second date indicator.

* * * * *